US011701550B2

(12) United States Patent
Sack et al.

(10) Patent No.: US 11,701,550 B2
(45) **Date of Patent: *Jul. 18, 2023**

(54) BALANCE BOARD WITH ADJUSTABLE TILT ANGLE AND ADJUSTABLE RESISTANCE

(71) Applicant: ESS 3 Tech, LLC, Bethlehem, PA (US)

(72) Inventors: James A. Sack, Elverson, PA (US); David A. Shoffler, Marion Heights, PA (US)

(73) Assignee: ESS 3 Tech, LLC, Bethlehem, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,154

(22) Filed: May 16, 2022

(65) Prior Publication Data

US 2022/0273987 A1 Sep. 1, 2022

Related U.S. Application Data

(63) Continuation of application No. 16/803,570, filed on Feb. 27, 2020, now Pat. No. 11,331,539.

(51) Int. Cl.
*A63B 26/00* (2006.01)

(52) U.S. Cl.
CPC ..... *A63B 26/003* (2013.01); *A63B 2225/09* (2013.01)

(58) Field of Classification Search
CPC ..... A63B 26/003; A63B 22/18; A63B 2071/0072; A63B 2220/40; A63B 2220/803; A63B 2220/833; A63B 2225/62
See application file for complete search history.

(56) References Cited

U.S. PATENT DOCUMENTS

| | | | |
|---|---|---|---|
| 3,352,559 | A | 11/1967 | Larsen |
| 4,279,107 | A | 7/1981 | Bollmann |
| 4,875,684 | A | 10/1989 | Benilan |

(Continued)

FOREIGN PATENT DOCUMENTS

| | | | |
|---|---|---|---|
| AT | 509939 | A1 | 12/2011 |
| DE | 102007048399 | A1 | 4/2009 |
| GB | 1372342 | A | 10/1974 |

OTHER PUBLICATIONS

International Search Report and Written Opinion dated May 6, 2021 in PCT Application No. PCT/US2021/019567.

*Primary Examiner* — Andrew S Lo
*Assistant Examiner* — Andrew M Kobylarz
(74) *Attorney, Agent, or Firm* — Plumsea Law Group, LLC

(57) ABSTRACT

A balance board, including: an upper plate having a top surface configured for a user to stand on; a base assembly configured to contact the ground; a center assembly pivotally connecting the upper plate with the base assembly; and an adjustable tilt system comprising at least a first adjustable angle stop configured to be rotated at adjustable intervals to change a maximum angle by which the upper plate may be tilted relative to the base assembly. The base assembly may include a first plurality of teeth. In addition, the first adjustable angle stop may include a second plurality of teeth configured to interface with the first plurality of teeth of the base assembly to provide fixation of the first adjustable angle stop at the adjustable intervals.

20 Claims, 20 Drawing Sheets

(56) References Cited

U.S. PATENT DOCUMENTS

| | | | | |
|---|---|---|---|---|
| 4,905,994 | A * | 3/1990 | Hartz | A63B 22/18 482/146 |
| 5,409,226 | A | 4/1995 | Mesko et al. | |
| 5,813,958 | A | 9/1998 | Tomita | |
| 5,851,166 | A | 12/1998 | Bernardson | |
| 6,017,010 | A | 1/2000 | Cui | |
| 6,249,983 | B1 | 6/2001 | Wright et al. | |
| 6,428,451 | B1 | 8/2002 | Hall | |
| 6,624,802 | B1 | 9/2003 | Klein et al. | |
| 7,241,070 | B2 | 7/2007 | McMurtry | |
| 7,775,952 | B1 | 7/2010 | Curran et al. | |
| 8,435,164 | B2 | 5/2013 | VanBuren | |
| 8,986,180 | B1 | 3/2015 | VanBuren et al. | |
| 9,446,307 | B2 | 9/2016 | Klein et al. | |
| 9,731,163 | B2 | 8/2017 | Henson | |
| 2,438,839 | A1 | 10/2019 | Beeh | |
| 10,434,371 | B2 * | 10/2019 | Shoffler | A63B 22/18 |
| 11,331,539 | B2 * | 5/2022 | Shoffler | A63B 26/003 |
| 2003/0125173 | A1 | 7/2003 | Fan et al. | |
| 2004/0023766 | A1 | 2/2004 | Slone | |
| 2007/0184953 | A1 | 8/2007 | Luberski et al. | |
| 2008/0146424 | A1 * | 6/2008 | Ho | A63B 24/00 482/147 |
| 2009/0227426 | A1 | 9/2009 | Dubar | |
| 2011/0039669 | A1 | 2/2011 | Stewart et al. | |
| 2014/0256526 | A1 * | 9/2014 | Henson | A63B 26/003 482/146 |
| 2016/0199699 | A1 | 7/2016 | Klassen | |
| 2018/0078822 | A1 | 3/2018 | Shoffler | |
| 2018/0193693 | A1 | 7/2018 | Youm | |

* cited by examiner

BALANCE BOARD WITH ADJUSTABLE TILT ANGLE AND ADJUSTABLE RESISTANCE

CROSS-REFERENCE TO RELATED APPLICATIONS

This application is a continuation of U.S. Patent Appl. Publ. No. 2021/0268337, published on Sep. 2, 2021, and entitled "Balance Board with Adjustable Tilt Angle and Adjustable Resistance," the entire disclosure of which is incorporated herein by reference.

BACKGROUND OF THE INVENTION

The present invention relates generally to a balance board and, more specifically, to a balance board with adjustable tilt angle and adjustable resistance.

Balance training devices are used for both fitness training as well as rehabilitation activities, such as physical therapy. One type of balance training device is a balance board with a tiltable upper platform upon which the user stands. The user stands on the balance board, often on only one foot, and performs active and/or passive balancing activities. For example, the user may simply attempt to maintain their balance on the unsteady platform, sometimes while performing a secondary task, such as playing catch with a medicine ball (a weighted ball). In other cases, the user may stand on the platform and proactively attempt to tilt the platform about one or more axes to develop the musculature required to articulate the ankle.

Balance boards have been developed that limit the degree of tilt in one or more directions. However, some of these devices are binary with respect to limiting tilt. In other words, these devices have only two settings, either they permit the tilt, or do not permit tilt. There is no graduated adjustment to permit less tilt or more tilt. Other devices can adjust the amount of tilt permitted, but do not do so incrementally. In rehabilitation exercises, it is desirable to be able to repeat an exercise with the device in the same configuration from session to session. In addition, the difficulty of therapy exercises is often increased periodically. Without any incremental tilt adjustment, it is difficult to track and increase the amount of tilt permitted in a regulated fashion.

In addition, it is desirable to vary the resistance to tilt. Greater resistance to tilt can be used to reduce the difficulty of passive balancing exercises, or to increase the difficulty of active balancing exercises. Resistance adjustments can be cumbersome, and are often not incremental in adjustment. As with the tilt adjustment, it is desirable for the resistance adjustment to be repeatable and incrementally adjustable.

The present disclosure is directed to addressing one or more of the issues discussed above.

SUMMARY OF THE INVENTION

In one aspect, the present disclosure is directed to a balance board. The balance board may include an upper plate having a top surface configured for a user to stand on; a base assembly configured to contact the ground; a center assembly pivotally connecting the upper plate with the base assembly; and an adjustable tilt system comprising at least a first adjustable angle stop configured to be rotated at adjustable intervals to change a maximum angle by which the upper plate may be tilted relative to the base assembly.

In another aspect, the present disclosure is directed to a balance board. The balance board may include an upper plate having a top surface configured for a user to stand on; a base assembly configured to contact the ground; and a center assembly pivotally connecting the upper plate with the base assembly. The center assembly may include a top pivot including a first multi-axial joint set at least partially within the upper plate and a lower pivot including a second multi-axial joint disposed proximate the upper plate. In addition, the first multi-axial joint may be a first ball and socket joint and the second multi-axial joint is a second ball and socket joint. Also, the first ball and socket joint may be disposed at least partially within the second ball and socket joint. In addition, the balance board may further include an adjustable tilt system comprising at least a first adjustable angle stop configured to be rotated to change a maximum angle by which the upper plate may be tilted relative to the base.

In another aspect, the present disclosure is directed to a balance board. The balance board may include an upper plate having a top surface configured for a user to stand on; a base assembly configured to contact the ground; and a center assembly pivotally connecting the upper plate with the base assembly. The center assembly may include a compressible member configured to provide resistance to tilting of the upper plate with respect to the base assembly. The compressible member may be configured to be raised and lowered with respect to the upper plate to change the amount of resistance to tilting provided by the compressible member.

Other systems, methods, features, and advantages of the invention will be, or will become, apparent to one of ordinary skill in the art upon examination of the following figures and detailed description. It is intended that all such additional systems, methods, features, and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

As used herein, the term "fixedly attached" shall refer to two components joined in a manner such that the components may not be readily separated (for example, without destroying one or both components). The term "removably attached" shall refer to components that are attached to one another in a readily separable manner (for example, with fasteners, such as bolts, screws, etc.).

As used herein, the terms "up," "upper," "top," "height," etc., and "down," "lower," "bottom," etc. shall refer to components and locations along a substantially vertical direction. Such terms shall be used with respect to the disclosed balance board with the base plate sitting on the ground (or floor) as intended during use.

Figure 1:
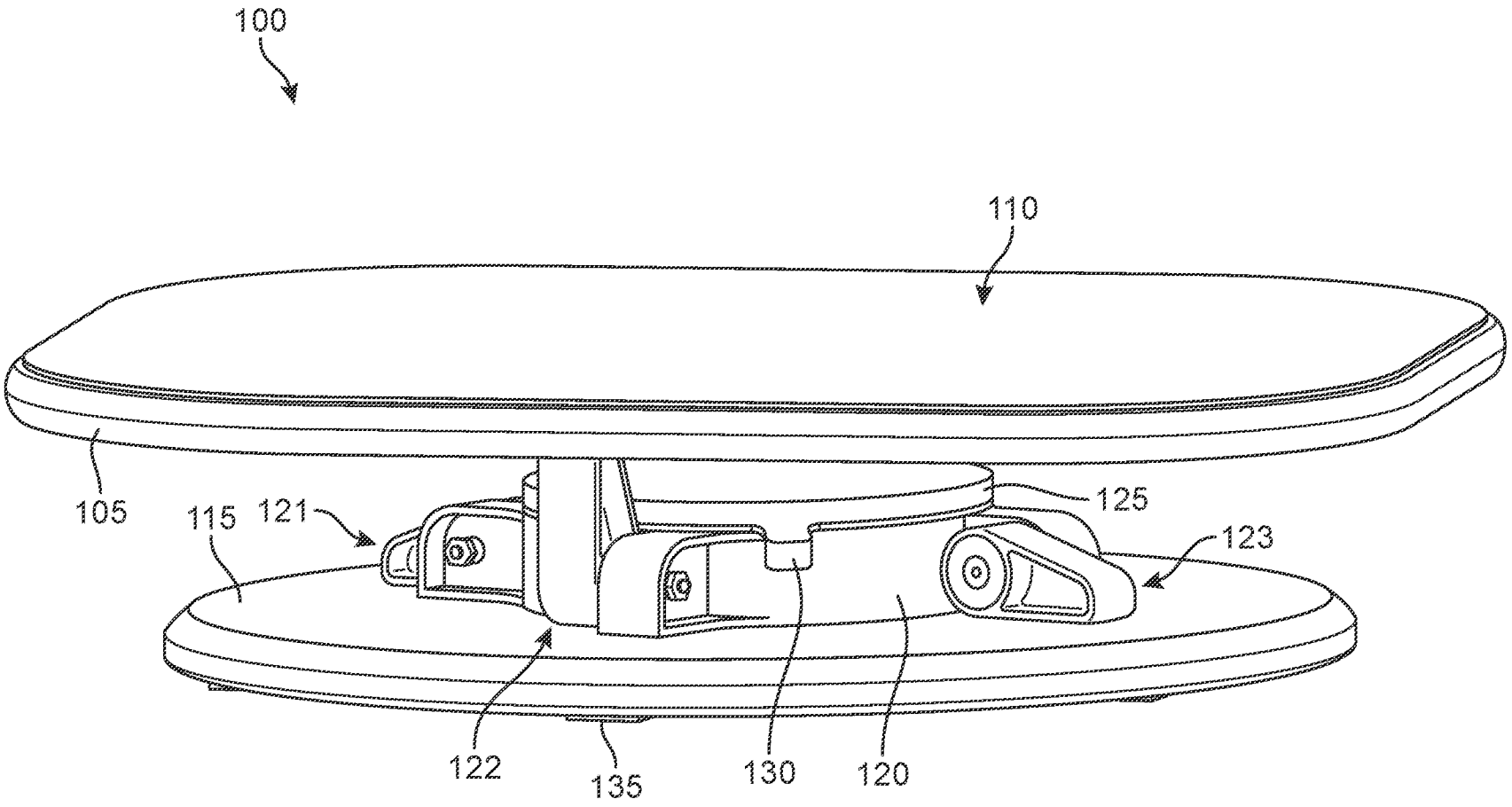
FIG. 1 is a schematic perspective view of a balance board according to an exemplary embodiment.

FIG. 1 is a schematic perspective view of a balance board according to an exemplary embodiment. In particular, FIG. 1 shows a balance board 100. As shown in FIG. 1, balance board 100 may include an upper plate 105 having a top surface 110 configured for a user to stand on. In addition, balance board 100 may include a base assembly configured to contact the ground. Base assembly may include a base plate 115, a support member 120, and a plurality of adjustable angle stops. For example, as discussed in greater detail below, in some embodiments, balance board 100 may include four evenly spaced adjustable angle stops. FIG. 1 shows a first adjustable angle stop 121, a second adjustable angle stop 122, and a third adjustable angle stop 123. The fourth adjustable angle stop is not shown in FIG. 1, as it is on the back side of balance board 100.

Balance board 100 may also include a center assembly pivotally connecting upper plate 105 with the base assembly. The center assembly may include multiple components. Of these multiple components, only two are shown in FIG. 1. In particular, a compressible member 125 and a resistance adjusting member 130 are both partially shown in FIG. 1. These and other components of center assembly are shown and discussed in greater detail with respect to other figures.

Figure 2:
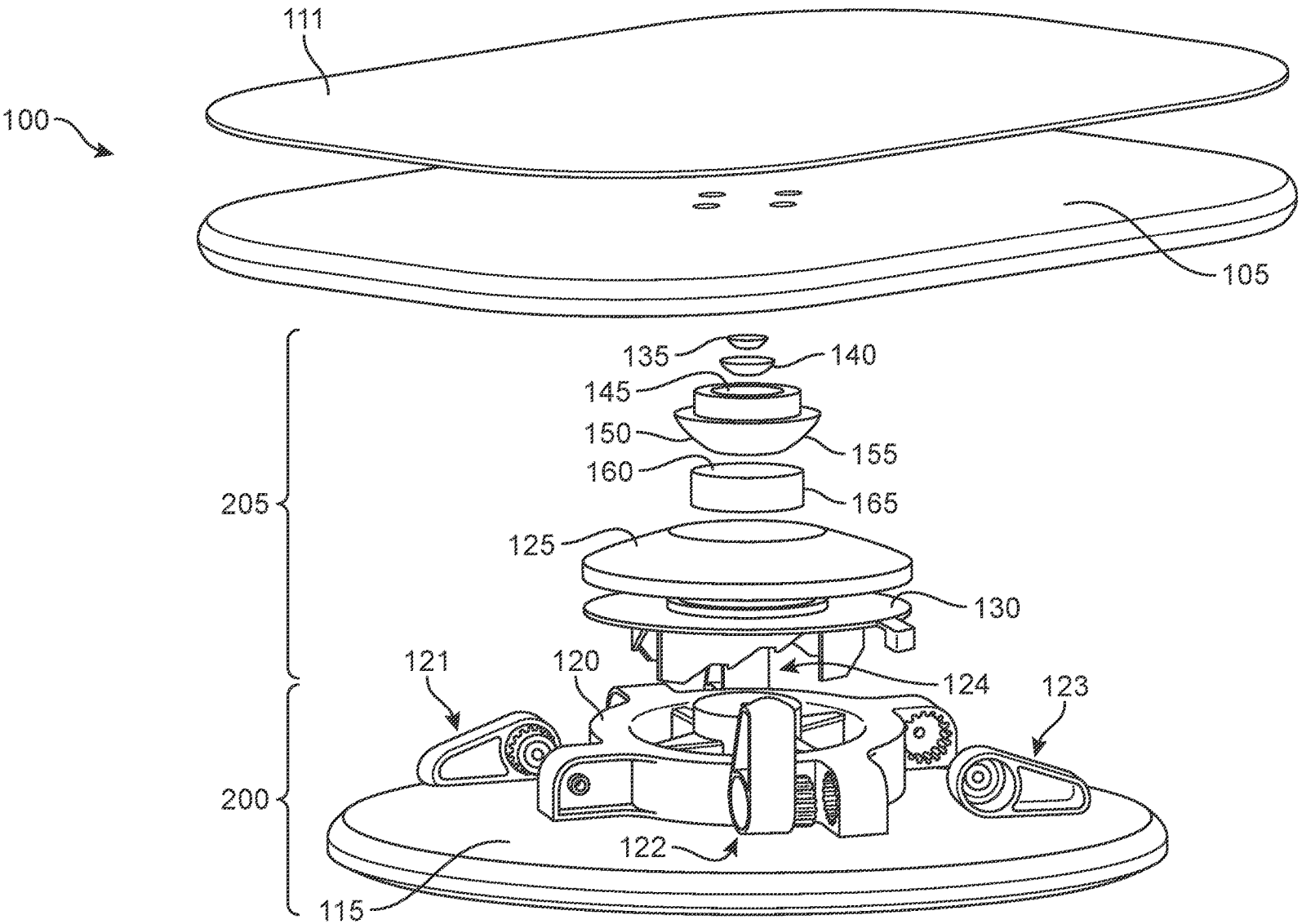
FIG. 2 is a schematic exploded view of the balance board shown in FIG. 1.

FIG. 2 is a schematic exploded view of the balance board shown in FIG. 1. FIG. 2 shows all components of balance board 100 except for the fasteners utilized to attach the illustrated components to one another. These fasteners have been removed from the view shown in FIG. 2 for clarity.

FIG. 2 shows the components of a base assembly 200. For example, as shown in FIG. 2, base assembly 200 may include base plate 115, support member 120, first adjustable angle stop 121, second adjustable angle stop 122, third adjustable angle stop 123, and a fourth adjustable angle stop 124. FIG. 2 also shows an anti-slip layer 111 configured to be affixed to the top of upper plate 105. Anti-slip layer 111 may have any suitable configuration including, for example, texture and/or anti-slip materials.

In addition, FIG. 2 shows the components of a center assembly 205. As shown in FIG. 2, center assembly 205 may include compressible member 125 and resistance adjusting member 130, as well as a rotational and pivoting assembly. In particular, the rotational and pivoting assembly may include a top pivot including a first multi-axial joint. The first multi-axial joint may permit upper plate 105 to rotate about a substantially vertical axis with respect to base assembly 200. In order to permit rotation, the first multi-axial joint may include a spherical bushing assembly. For example, the first multi-axial joint may include a first semi-spherical bushing element 135 and a second semi-spherical element 140, which may nest within one another. These components may form a first spherical bushing set, which permits upper plate 105 to rotate about a vertical axis with respect to base assembly 200.

To form the first ball and socket joint, second semi-spherical element 140 may articulate against a concave, semi-spherical surface 145 of a third semi-spherical member 150. In some embodiments, the first ball and socket joint may be set at least partially within upper plate 105 (see FIG. 3.).

In some embodiments, center assembly 205 may include a second multi-axial joint, which may include a second ball and socket joint. In some embodiments, the second ball and socket joint may be disposed proximate upper plate 105. As shown in FIG. 2, third semi-spherical member 150 may have a semi-spherical convex surface 155 configured to articulate against a concave semi-spherical surface 160 of a fourth semi-spherical member 165.

Figure 3:
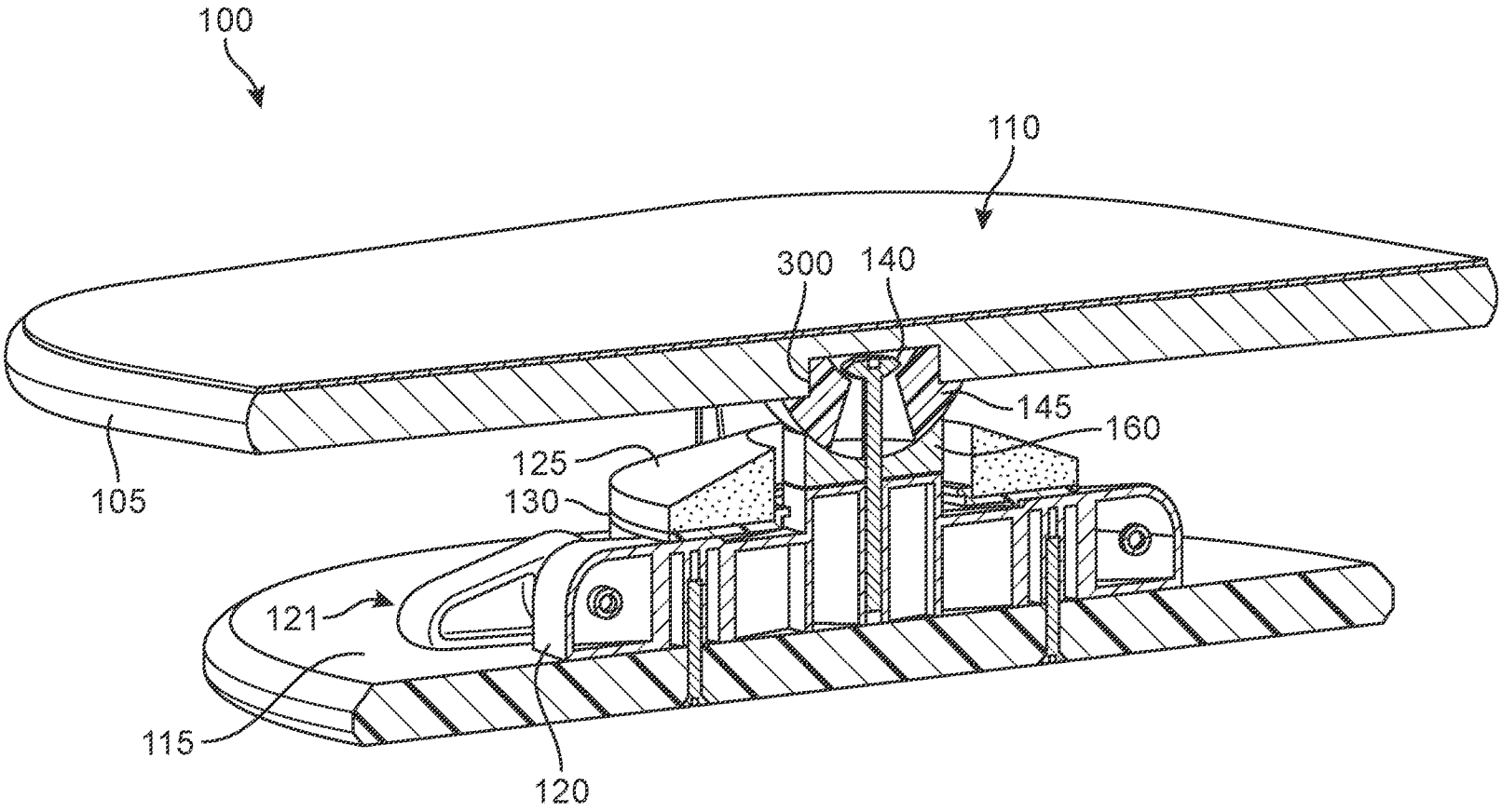
FIG. 3 is a schematic cutaway cross-sectional view of the balance board shown in FIG. 1.

FIG. 3 is a schematic cutaway cross-sectional view of the balance board shown in FIG. 1. As shown in FIG. 3, in some embodiments, the first ball and socket joint may be disposed at least partially within the second ball and socket joint. In particular, the first ball and socket joint formed between second semi-spherical member 140 and third semi-spherical member 145 may be disposed at least partially within the second ball and socket joint formed between third semi-spherical member 145 and fourth semi-spherical member 160.

In addition, it will be noted that, in some embodiments, at least a portion of the first ball and socket joint may be set within the upper plate. For example, as shown in FIG. 3, the interface between second semi-spherical member 140 and third semi-spherical member 145 may be set within a recess 300 in upper plate 105.

FIGS. 4-8 show an adjustable tilt system including at least a first adjustable angle stop configured to be rotated to change a maximum angle by which the upper plate may be tilted relative to the base assembly.

Figure 4:
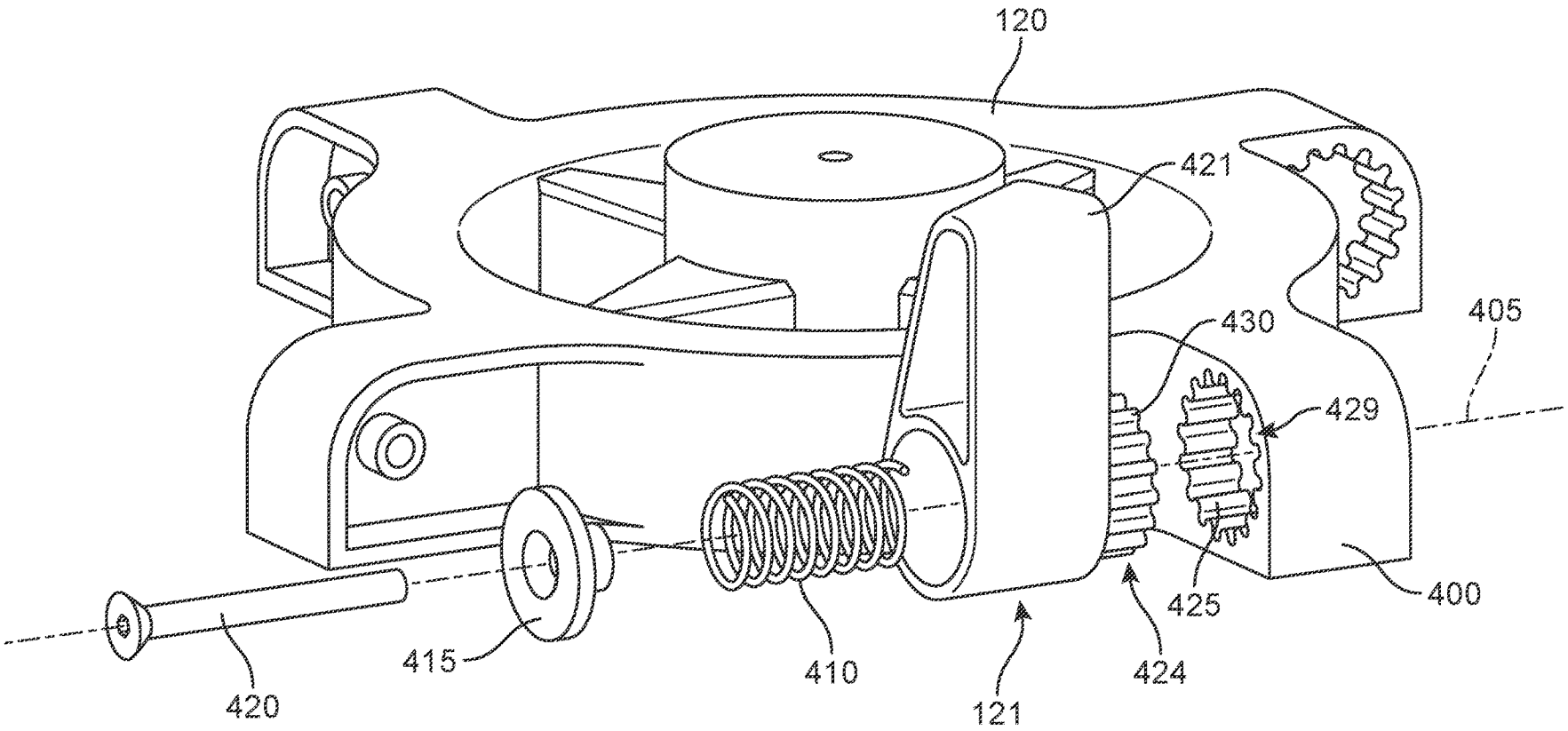
FIG. 4 is a schematic exploded view of an adjustable tilt system according to an exemplary embodiment.

FIG. 4 is a schematic exploded view of an adjustable tilt system according to an exemplary embodiment. The adjustable tilt system may include support member 120 and a plurality of adjustable angle stops, such as first adjustable angle stop 121. Support member 120 may include a plurality of lobes, such as a first lobe 400, extending radially outward from the center of support member 120. A cylindrical protrusion 424 of first adjustable angle stop 121 may be removably fitted within a recess 429 of first lobe 400.

Recess 429 and cylindrical protrusion 424 may be aligned along a substantially horizontal axis 405. First adjustable angle stop 121 may be configured to be rotated about axis 405 in order to adjust the maximum tilt of the upper plate of the balance board.

Also aligned on axis 405 may be a spring 410, a spring cap 415, and a screw 420 configured to hold spring cap 415 against spring 410 in order to bias cylindrical protrusion 424 of first adjustable angle stop 121 into position within first recess 429.

Each adjustable angle stop may be configured to be rotated at adjustable intervals to change a maximum angle by which the upper plate may be tilted relative to the base assembly. As shown in FIG. 4, the adjustable intervals or increments may be provided by interlocking teeth on cylindrical protrusion 424 and the inner wall of recess 429. In particular, recess 429 may include a first plurality of teeth 425 extending radially inward, and cylindrical protrusion 424 may include a second plurality of teeth 430 extending radially outward and configured to interface with first plurality of teeth 425 of the base assembly to provide fixation of first adjustable angle stop 121 at adjustable intervals.

In some embodiments, the incremental adjustment of the adjustable angle stops 121 may be graduated. That is, in some embodiments, markings may be provided on the lobes of support member 120. Such markings may be numbered, e.g., 1 through 5. In some cases, a corresponding marking may be provided on each adjustable angle stop. In this way, the adjustable angle stops around the balance board may easily be adjusted to the same angle. In addition, the adjustable angle stops may be adjusted to the same angle from one rehab session to the next.

In order to provide the adjustable restriction to tilt, first adjustable angle stop 121 has a cam 421. Rotating first adjustable angle stop 121 adjusts a vertical location of cam 421 relative to substantially horizontal axis 405 about which first adjustable angle stop 121 is configured to rotate.

Figure 5:
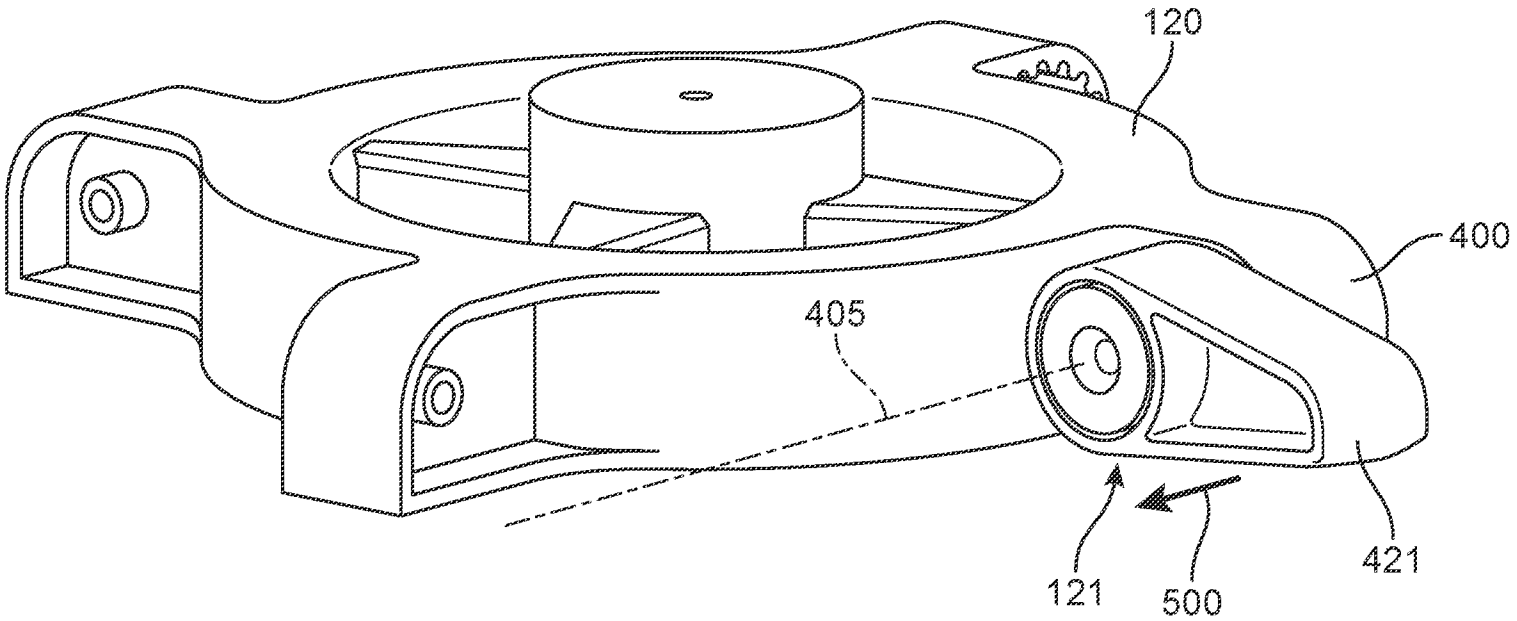
FIG. 5 is a schematic assembled view of the adjustable tilt system of FIG. 4 in a maximum tilt configuration.

FIG. 5 is a schematic assembled view of the adjustable tilt system of FIG. 4 in a maximum tilt configuration. That is, in the configuration shown in FIG. 5, cam 421 is rotated downward and extending substantially parallel to the ground. In other words, cam 421 is in the lowest position available.

In order to rotate adjustable angle stop 121 such that cam 421 can be moved upward or downward, the main body of adjustable angle stop 121 can be pulled in the direction of arrow 500 against the bias of spring 410, thus pulling cylindrical protrusion 424 out of recess 429 and disengaging second plurality of teeth 430 from first plurality of teeth 425 (see FIG. 4 for hidden componentry).

Figure 6:
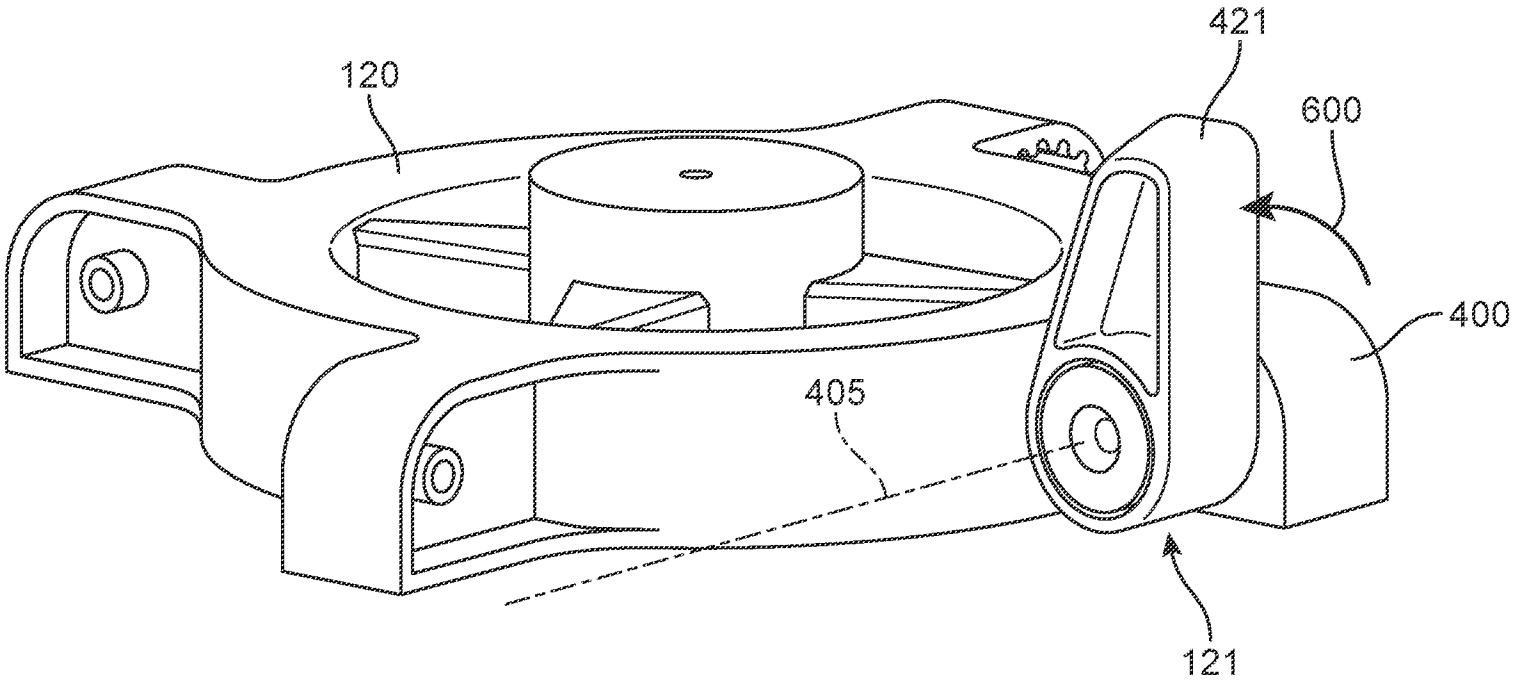
FIG. 6 is a schematic assembled view of the adjustable tilt system of FIG. 4 in a minimum tilt configuration.

FIG. 6 is a schematic assembled view of the adjustable tilt system of FIG. 4 in a minimum tilt configuration. Once the teeth are disengaged, adjustable angle stop 121 may be rotated in the direction of arrow 600, thus raising the vertical position of cam 421.

Figure 7:
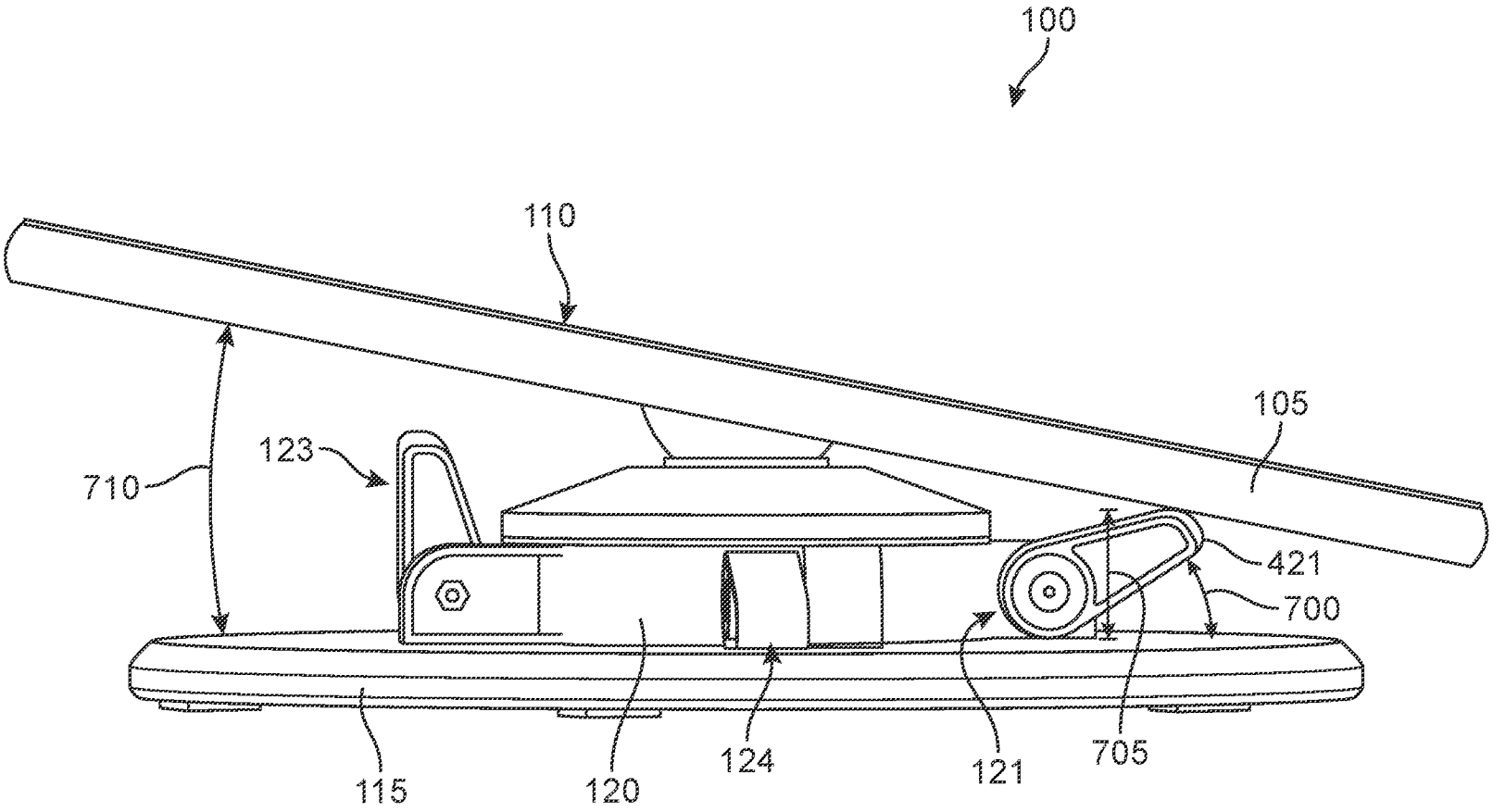
FIG. 7 is a schematic side view of the balance board of FIG. 1, shown in an intermediate tilt configuration.

FIG. 7 is a schematic side view of the balance board of FIG. 1, shown in an intermediate tilt configuration. As shown in FIG. 7, first adjustable angle stop 121 is rotated to a position where cam 421 is part way between horizontal and vertical. That is, the angle 700 at which cam 421 extends is between zero and 90 degrees. The positioning of cam 421 at angle 700 sets the tip of cam 421 at a height 705 relative to base plate 115. This height 705 determines a maximum tilt angle 710 at which upper plate 105 can tilt in the direction of first adjustable angle stop 121. It will be noted that angle 700 and angle 710 are inversely related. That is, the smaller angle 700 is the greater maximum tilt angle 710 will be permitted.

As discussed above, balance board 100 may include a plurality of adjustable angle stops disposed around a periphery of the base assembly. In some embodiments, the plurality of adjustable angle stops may each have substantially the same configuration as first adjustable angle stop 121.

In some embodiments, the plurality of adjustable angle stops may include four adjustable angle stops evenly spaced at 90 degree intervals around the periphery of the base assembly. These four adjustable angle stops may be individually adjusted to provide a customized maximum tilt angle in each of the four directions in which the four adjustable angle stops are located. Accordingly, if a user has a greater range of motion in one axis than another, the adjustable angle stops may be set differently from one another to permit more tilt about the axis in which the user has a better range of motion. In FIG. 7, third adjustable angle stop 123 is shown in a minimum tilt configuration, fourth adjustable angle stop 124 is shown in a maximum tilt configuration, and first adjustable angle stop 121 is shown in an intermediate tilt configuration. Because of the interlocking teeth discussed above, and shown in FIG. 4, the adjustable angle stops may be set at several intervals between maximum tilt and minimum tilt.

Also, because the adjustable angle stops are individually adjustable, balance board 100 is configured to be converted from a multi-axis wobble board to a single-axis rocker board by adjusting opposing adjustable angle stops to prevent pivotal movement of the upper plate about all but one horizontal axis.

In some embodiments, the balance board may include provisions to adjust the resistance to tilting of the upper plate. For example, a height adjustable compressible member may contact the upper plate at varying degrees of tilt in order to provide varying amounts of resistance to the tilting motion.

Figure 8:
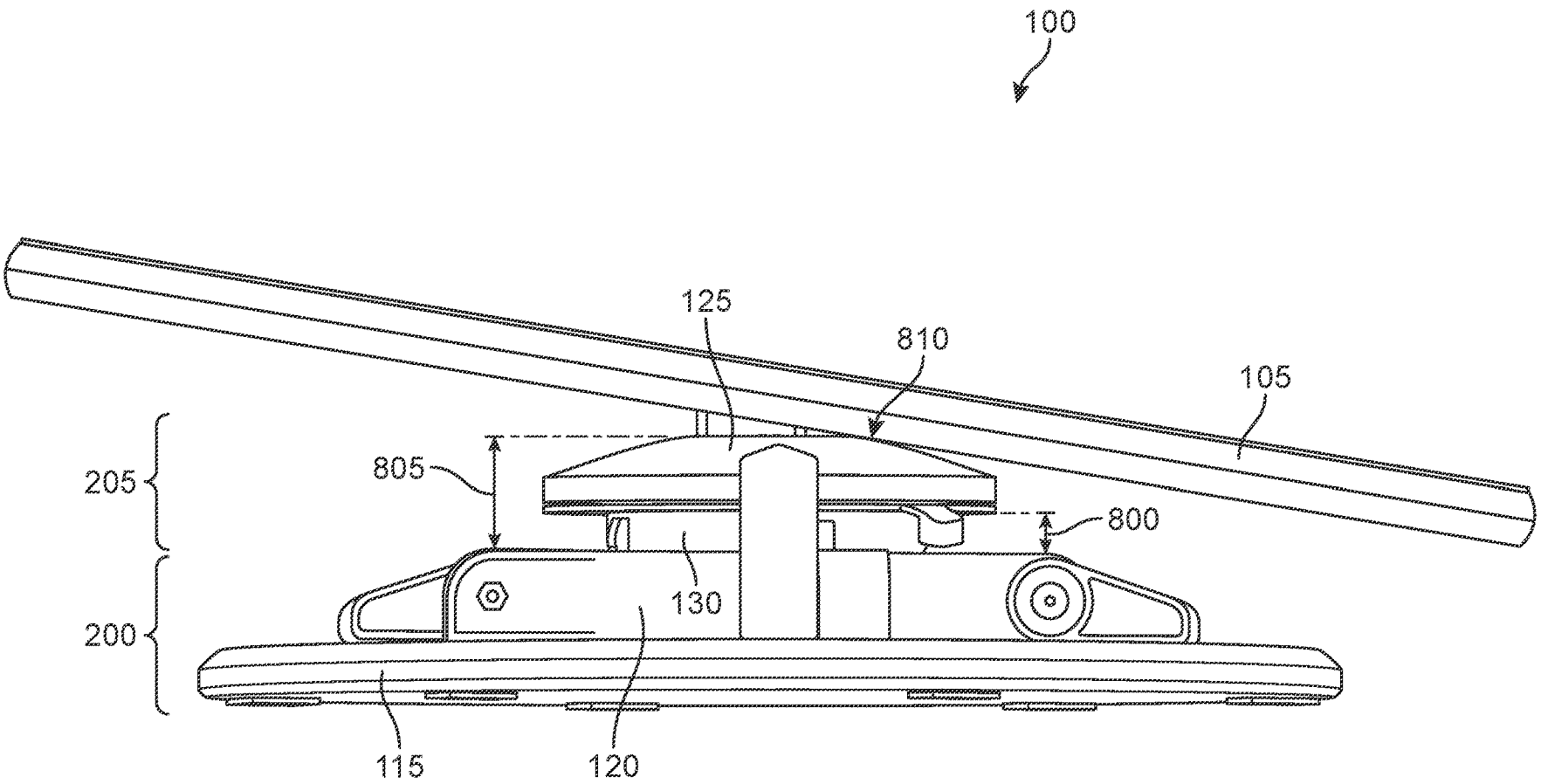
FIG. 8 is a schematic side view of the balance board of FIG. 1, shown in a high tilt resistance configuration.

FIG. 8 is a schematic side view of the balance board of FIG. 1, shown in a high tilt resistance configuration. As illustrated in FIG. 8, compressible member 125 is shown in an elevated position, as illustrated by a height 800, showing the amount by which compressible member 125 has been raised. By raising the ultimate height 805 of compressible member, the top of compressible member 125 may be brought closer to the underside of upper plate 105. When upper plate 105 is tilted, it comes into contact with compressible member 125 illustrated by an interface 810. To further tilt upper plate 105, more resistance is required to overcome the resiliency of compressible member 125.

Setting a high resistance may make a balancing exercise easier, which can be beneficial to users who are not advanced with respect to completing such exercises. In other words, the resistance provides assistance to the user such that the balancing is not as difficult.

Figure 9:
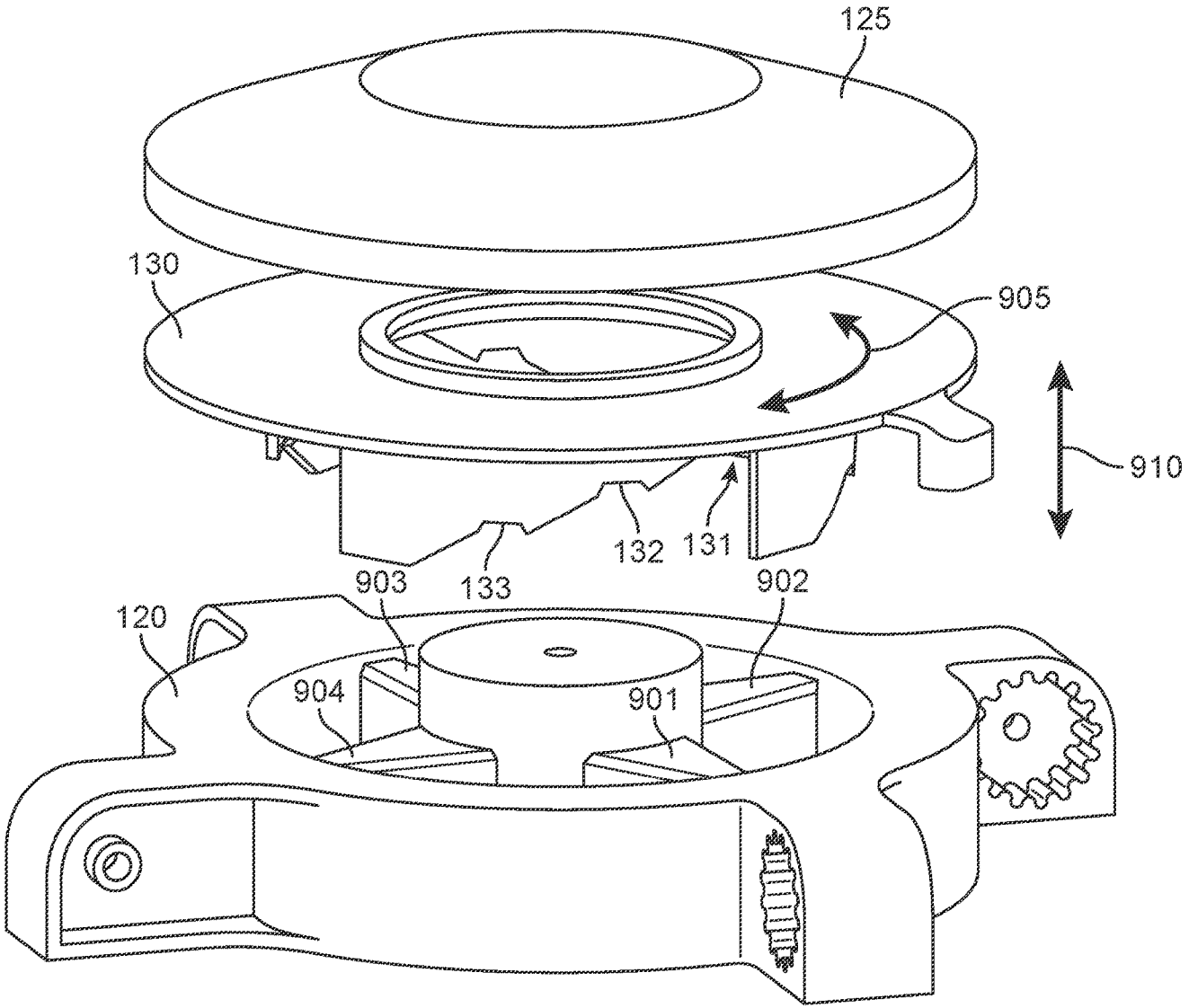
FIG. 9 is a schematic exploded view of a tilt resistance system.
Figure 10:
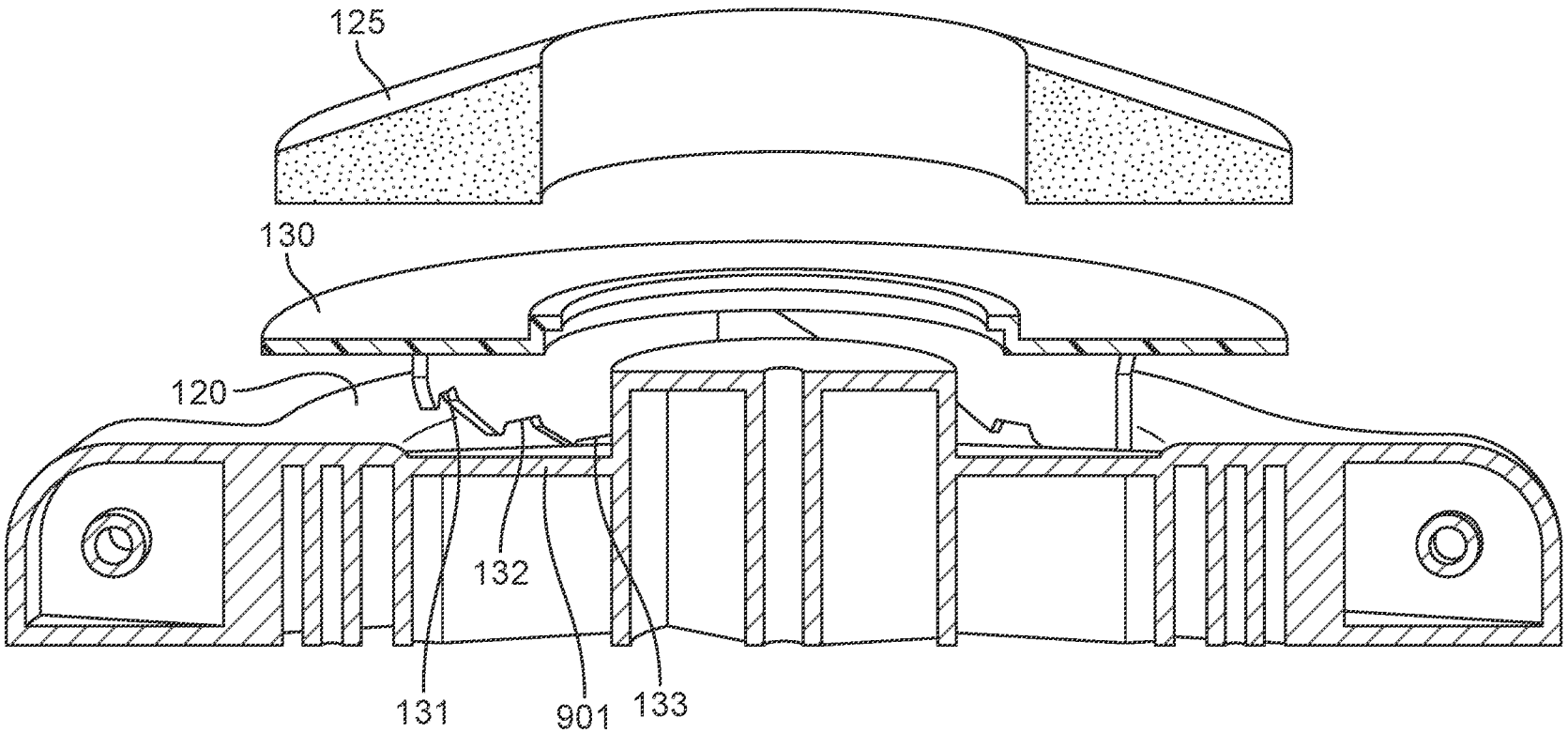
FIG. 10 is a schematic exploded cutaway cross-sectional view of the tilt resistance system shown in FIG. 9.

Compressible member 125 may be raised by rotating resistance adjusting member 130. FIGS. 9 and 10 illustrate the mechanism by which resistance adjusting member 130 may raise and lower compressible member 125.

FIG. 9 is a schematic exploded view of a tilt resistance system. FIG. 9 shows support member 120, which is connected to the base plate (not shown in FIG. 9) and configured to support the central assembly. Support member 120 includes a plurality of radial supports configured to support resistance adjusting member 130. For example, support member 120 may include a first radial support 901, a second radial support 902, a third radial support 903, and a fourth radial support 904.

Resistance adjusting member 130 may include a plurality of shoulders arranged in a stepped configuration such that positioning different steps against the radial supports of the support member incrementally adjusts the vertical placement of resistance adjusting member 130 relative to the base assembly. As discussed above, adjusting the vertical placement of resistance adjusting member 130 adjusts the vertical placement of compressible member 125 to adjust the resistance to tilting of the upper plate relative to the base assembly.

One set of stepped shoulders of resistance adjusting member 130 are shown and labeled in FIG. 9. In particular, a first shoulder 131, a second shoulder 132, and a third shoulder 133 are all configured to interface with first radial support 901 of support member 120. There are four such sets of shoulders arranged around resistance adjusting member 130, one set corresponding with each radial support of support member 120.

The positioning of resistance adjusting member 130 at different vertical placements is performed by rotating resistance adjusting member 130 relative to support member 120 in a direction indicated by a first arrow 905. That is, by moving resistance adjusting member 130 in a circumferential rotation indicated by first arrow 905, the user may select which of the shoulders are positioned on the radial supports, thus moving resistance adjusting member up and down, as indicated by a second arrow 910. For example, if first shoulder 131 is positioned on first radial support 901, resistance adjusting member 130, and consequently compressible member 125, will be disposed at their lowest setting, which corresponds with the least amount of tilt resistance provided. If second shoulder 132 is positioned on first radial support 901, then resistance adjusting member 130, and consequently compressible member 125, will be disposed at an intermediate setting, which corresponds with an intermediate level of tilt resistance provided. If third shoulder 133 is positioned on first radial support 901, then resistance adjusting member 130, and consequently compressible member 125, will be disposed at a maximum height setting, which corresponds with a maximum level of tilt resistance provided.

For additional detail, FIG. 10 is a schematic exploded cutaway cross-sectional view of the tilt resistance system shown in FIG. 9. In particular, FIG. 10 shows, from another angle, the relationship between first shoulder 131, second shoulder 132, and third shoulder 133 and first radial support 901.

As also shown in FIG. 10, in some embodiments, compressible member 125 may be a substantially conical component. As such, when the balance board is assembled, compressible member 125 may be arranged substantially concentrically around the second multi-axial joint. (See FIG. 3.) In other embodiments, compressible member 125 may have a different configuration. For example, in some embodiments, compressible member 125 may have a substantially rectangular, oval, or circular cross-sectional shape.

Figure 11:
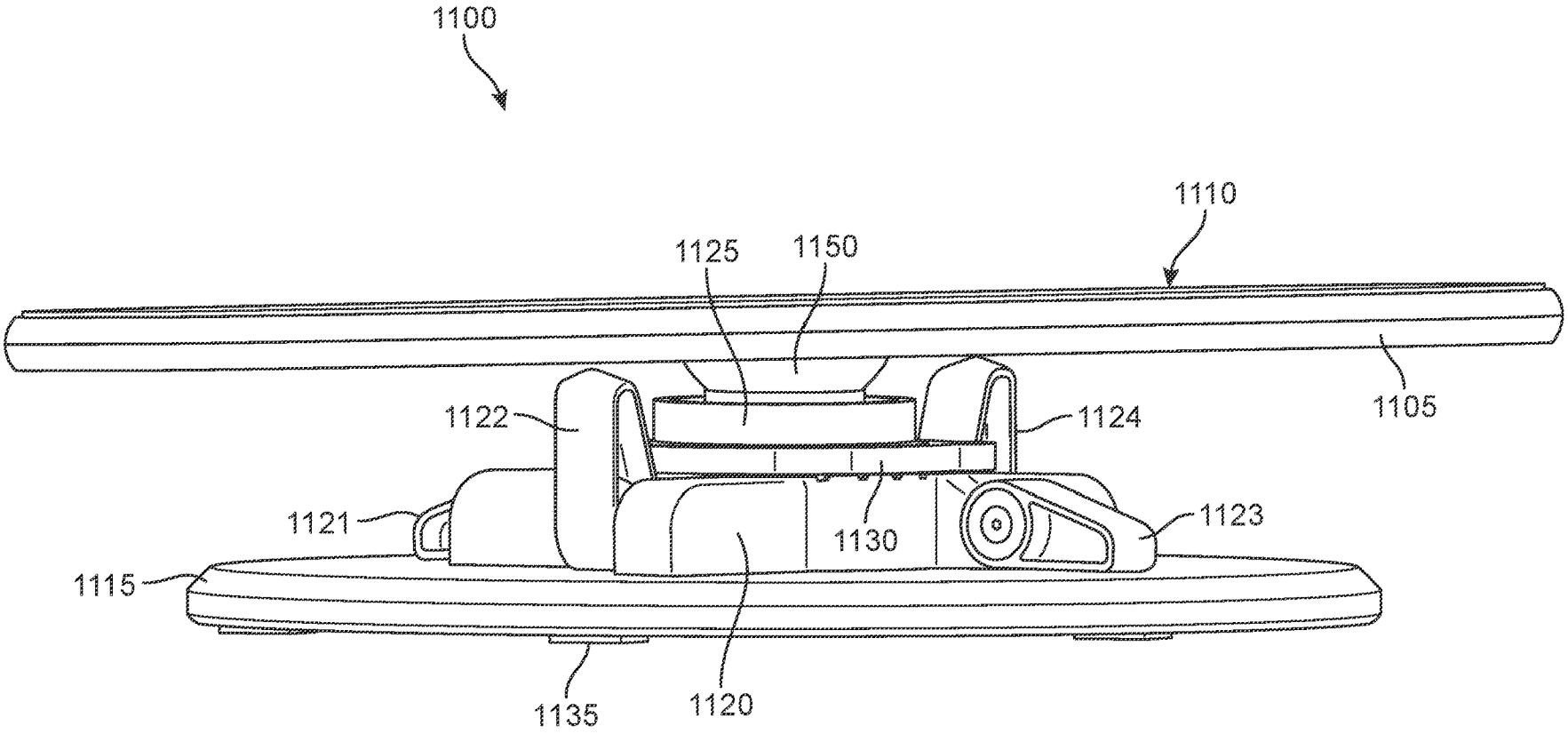
FIG. 11 is a schematic side view of a balance board according to another exemplary embodiment.

FIG. 11 is a schematic side view of a balance board according to another exemplary embodiment. In particular, FIG. 11 shows a balance board 1100. As shown in FIG. 11, balance board 1100 may include an upper plate 1105 having a top surface 1110 configured for a user to stand on. In addition, balance board 1100 may include a base assembly configured to contact the ground. Base assembly may include a base plate 1115, a support member 1120, and a plurality of adjustable angle stops. For example, as discussed in greater detail below, in some embodiments, balance board 1100 may include four evenly spaced adjustable angle stops. FIG. 11 shows a first adjustable angle stop 1121, a second adjustable angle stop 1122, a third adjustable angle stop 1123, and a fourth adjustable angle stop 1124.

It will be noted that, as shown in FIG. 11, the adjustable angle stops have beveled tips in order to accommodate the tilting of the upper plate 1105. For example, as shown in FIG. 11, second adjustable angle stop 1122 has a beveled tip proximate to upper plate 1105. Similarly, the beveled tip of fourth adjustable angle stop 1124 is also visible in FIG. 11. These beveled tips facilitate the tilting of upper plate 1105 back and forth toward first adjustable angle stop 1121 and third adjustable angle stop 1123. The upper facing surfaces of the adjustable angle stops may also be beveled, albeit at a shallower angle than the tips of the adjustable angle stops.

It will also be noted that the adjustable angle stops are positioned along the centerline of the balance board. This enables the upper plate to tilt along the axes extending between opposing adjustable angle stops.

Figure 12:
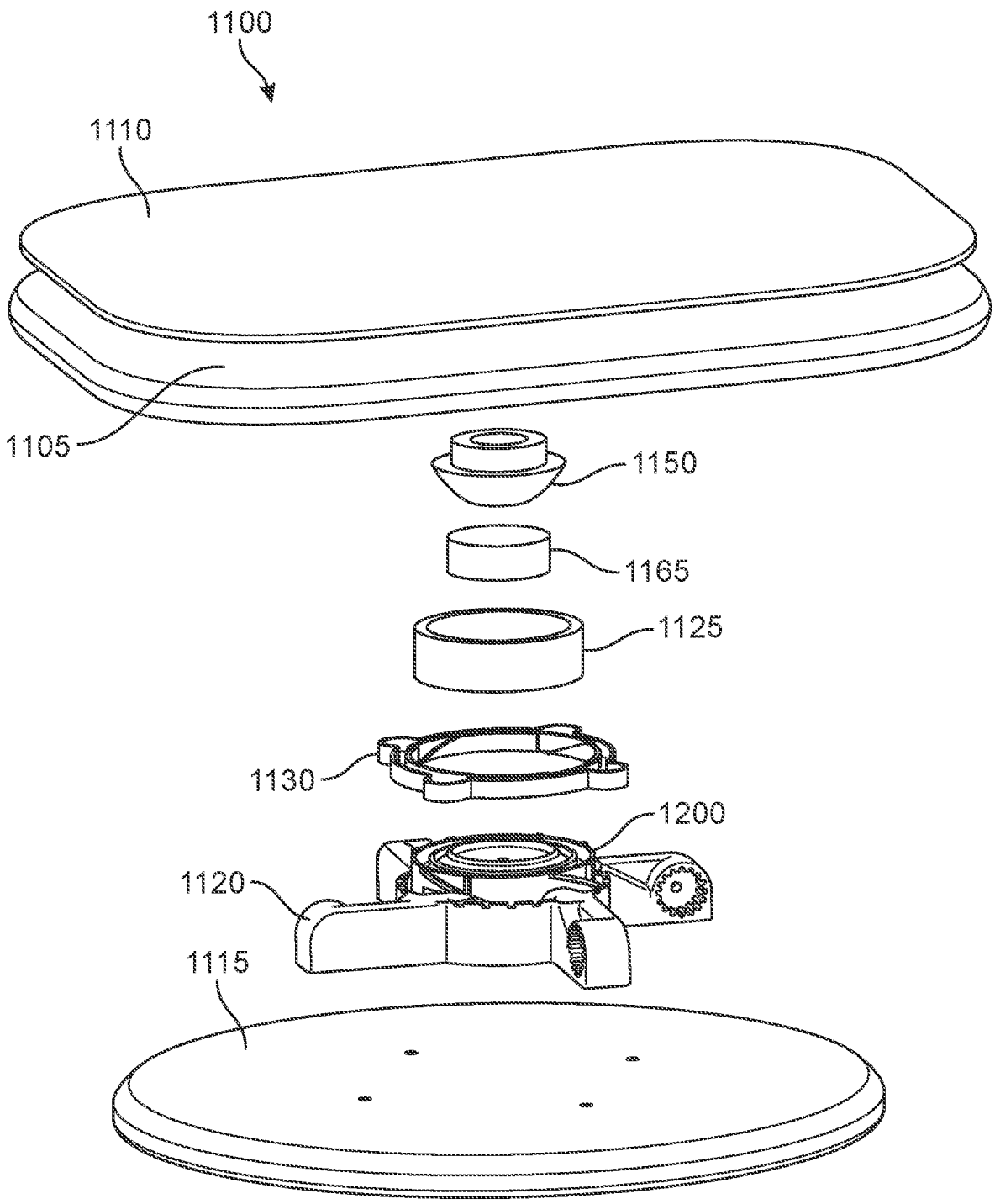
FIG. 12 is a schematic exploded view of the balance board shown in FIG. 11.

Balance board 1100 may also include a center assembly pivotally connecting upper plate 1105 with the base assembly. The center assembly may include multiple components. Of these multiple components, only three are shown in FIG. 11. In particular, a first semi-spherical member 1150 is shown (a mating second semi-spherical member is shown in FIG. 12). In addition, a compressible member 1125 and a rotatable ring 1130 are both partially shown in FIG. 11. These and other components of center assembly are shown and discussed in greater detail with respect to other figures.

FIG. 12 is a schematic exploded view of the balance board shown in FIG. 11. FIG. 12 shows most of the main components but, for purposes of clarity, certain small components, such as fasteners that hold the main components together, are omitted. As shown in FIG. 12, balance board 1100 may include first semi-spherical component 1150 and a second, mating semi-spherical component 1165. The interaction of first semi-spherical component 1150 and second semi-spherical component 1165 may be the same or similar to the interaction between third semi-spherical member 150 and fourth semi-spherical member 165 discussed above.

FIG. 12 also shows rotatable ring 1130 and a mating elevating member 1200. The interaction between rotatable ring 1130 and elevating member 1200 is discussed in greater detail below.

Figure 13:
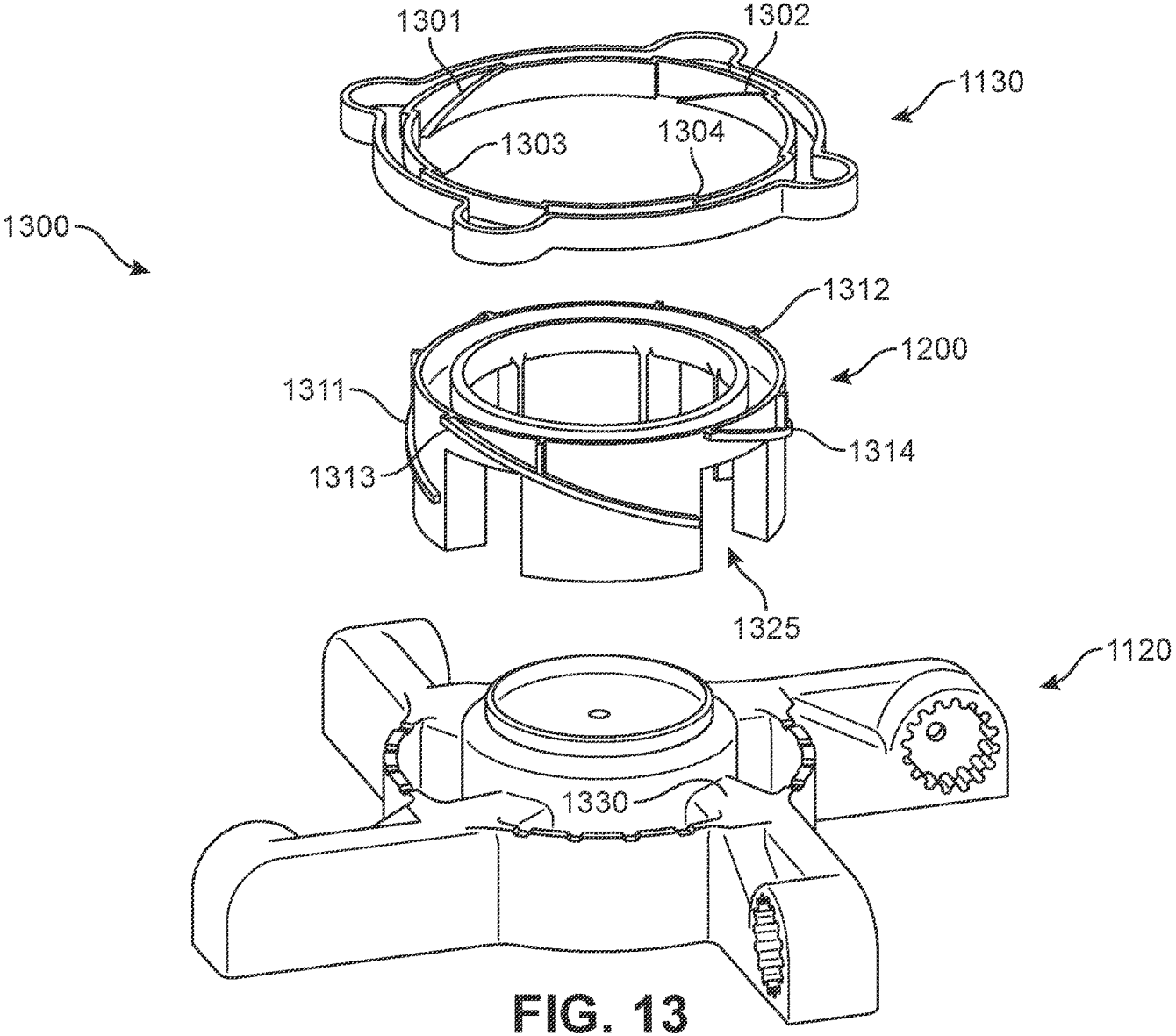
FIG. 13 is a schematic exploded view of a resistance adjustment system of the balance board shown in FIG. 11.

FIG. 13 is a schematic exploded view of a resistance adjustment system of the balance board shown in FIG. 11. As shown in FIG. 13, the balance board may include a resistance adjustment system 1300 configured to raise and lower the compressible member with respect to the upper plate. As further shown in FIG. 13, resistance adjustment system 1300 may include rotatable ring 1130, elevating member 1200, and support member 1120.

Rotatable ring may include one or more spiral ramps configured to interact with one or more spiral ribs on the elevating member to raise and lower the elevating member. For example, as shown in FIG. 13, rotatable ring 1130 may include a first spiral ramp 1301, a second spiral ramp 1302, a third spiral ramp 1303, and a fourth spiral ramp 1304. As further shown in FIG. 13, elevating member 1200 may include a first spiral rib 1311, a second spiral rib, 1312, a third spiral rib 1313, and a fourth spiral rib 1314. Upon rotating the rotatable ring 1130, first spiral ramp 1301 may interact with first spiral rib 1311, second spiral ramp 1302 may interact with second spiral rib 1312, third spiral ramp 1303 may interact with third spiral rib 1313, and fourth spiral ramp 1304 may interact with fourth spiral rib 1314 to raise and lower elevating member 1200. In order to prevent elevating member 1200 from rotating upon rotation of rotatable member 1130, elevating member 1200 may include a plurality of slots 1325 configured to mate with a plurality of radially extending members 1330 of support member 1120. The interlocking between slots 1325 and radially extending members 1330 may also prevent undesired adjustment of the resistance adjusting system, for example, during rotation of the upper plate of the balance board.

The four ramps and four spiral ribs essentially forms a four-start thread system. This may reduce complexity in the components, which may facilitate manufacturing. Nevertheless, it will be understood that rotatable ring 1130 may include any suitable number of spiral ramps. Likewise, elevating member 1200 may include any suitable number of spiral ribs.

Figure 14:
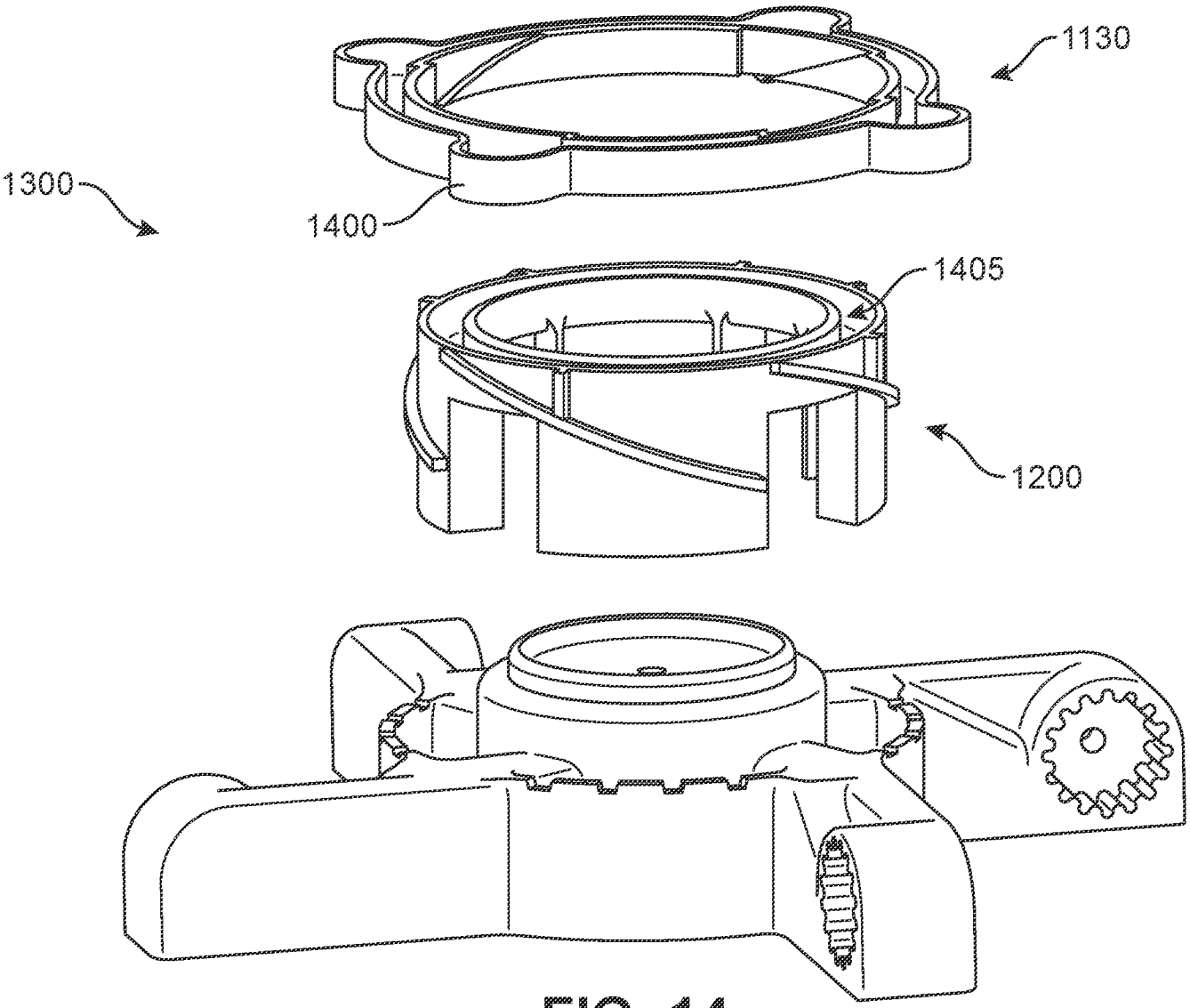
FIG. 14 is another schematic exploded view of the resistance adjustment system shown in FIG. 13.

FIGS. 14-17 illustrate the operation of resistance adjustment system 1300. FIG. 14 is another schematic exploded view of the resistance adjustment system shown in FIG. 13. As shown in FIG. 14, rotatable ring 1130 may include at least one lobe 1400 configured to facilitate rotation of rotatable ring 1130. As also shown in FIG. 14, elevating member 1200 may include a groove 1405 configured to receive a bottom portion of compressible member 1125 (see FIG. 17).

Figure 15:
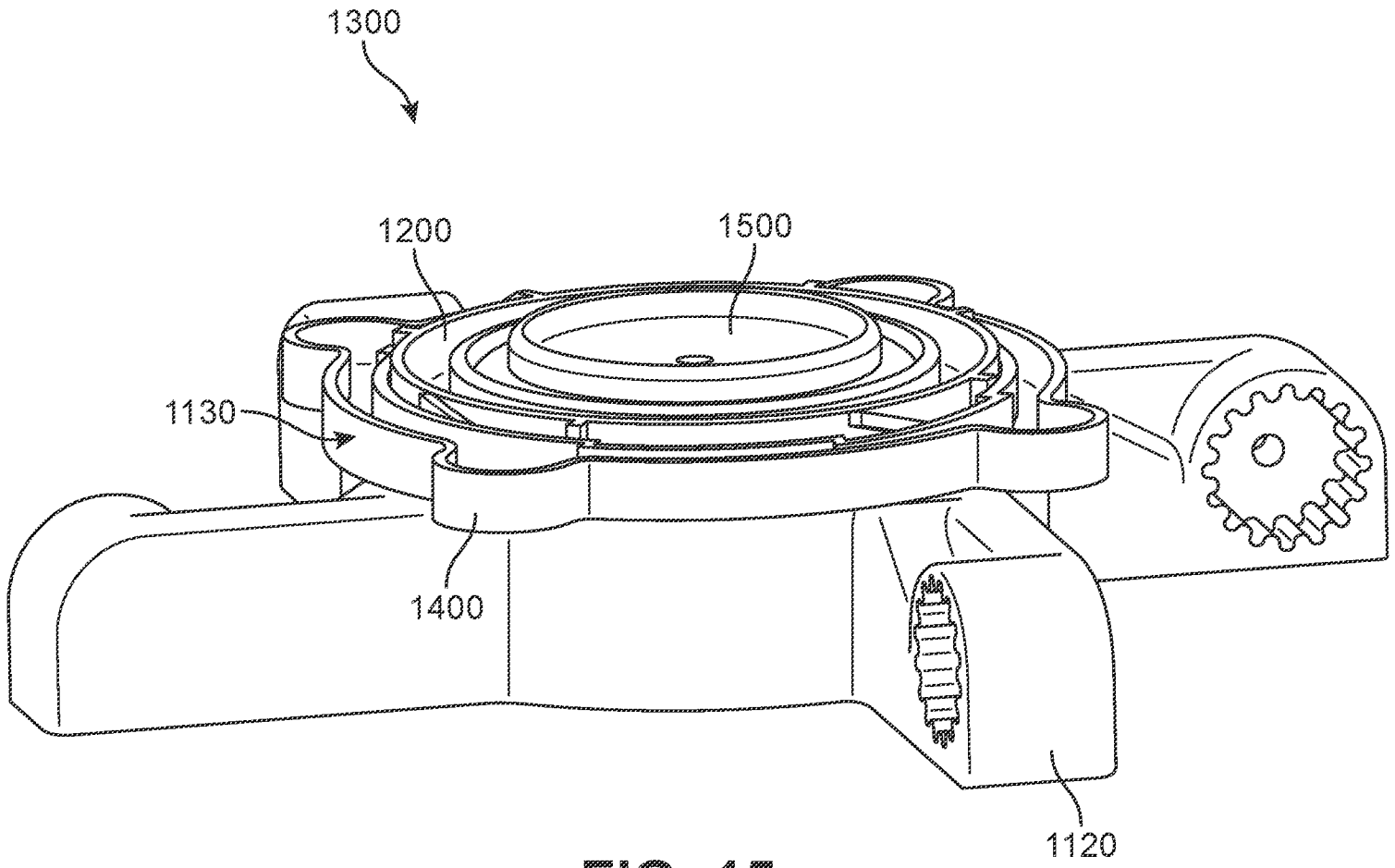
FIG. 15 is a schematic assembled view of the resistance adjustment system shown in FIG. 13 in a low resistance position.

FIG. 15 is a schematic assembled view of the resistance adjustment system shown in FIG. 13 in a low resistance position. As shown in FIG. 15, rotatable ring 1130, elevating member 1200, and a central portion 1500 of support member 1120 may be concentrically arranged within one another. FIG. 15 illustrates the resistance adjustment system 1300 in the most collapsed position, that is, with elevating member 1200 in the lowest position. In this position, the compressible member sits the lowest with respect to the upper plate of the balance board, and thus provides the least resistance to tilting of the upper plate.

Figure 16:
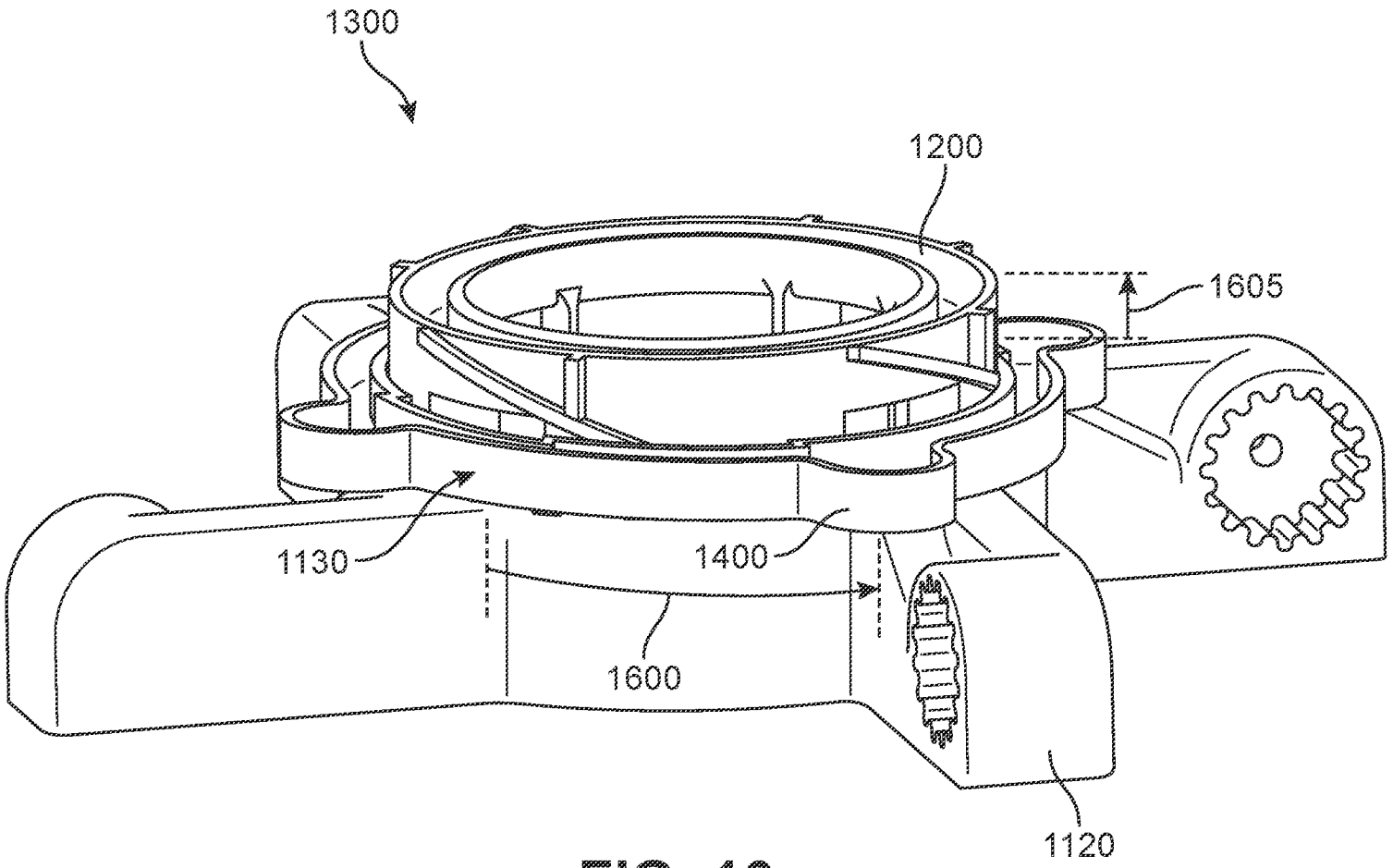
FIG. 16 is a schematic assembled view of the resistance adjustment system shown in FIG. 13 in a high resistance position.

FIG. 16 is a schematic assembled view of the resistance adjustment system shown in FIG. 13 in a high resistance position. As shown in FIG. 16, rotatable ring 1130 has been rotated an amount indicated by a first arrow 1600, which shows the rotation of lobe 1400. Due to the interaction of the spiral ramps of rotatable ring 1130 and the spiral rings of elevating member 1200, this rotation of rotating member 1130 may raise elevating member 1200 a distance illustrated by a second arrow 1605.

Figure 17:
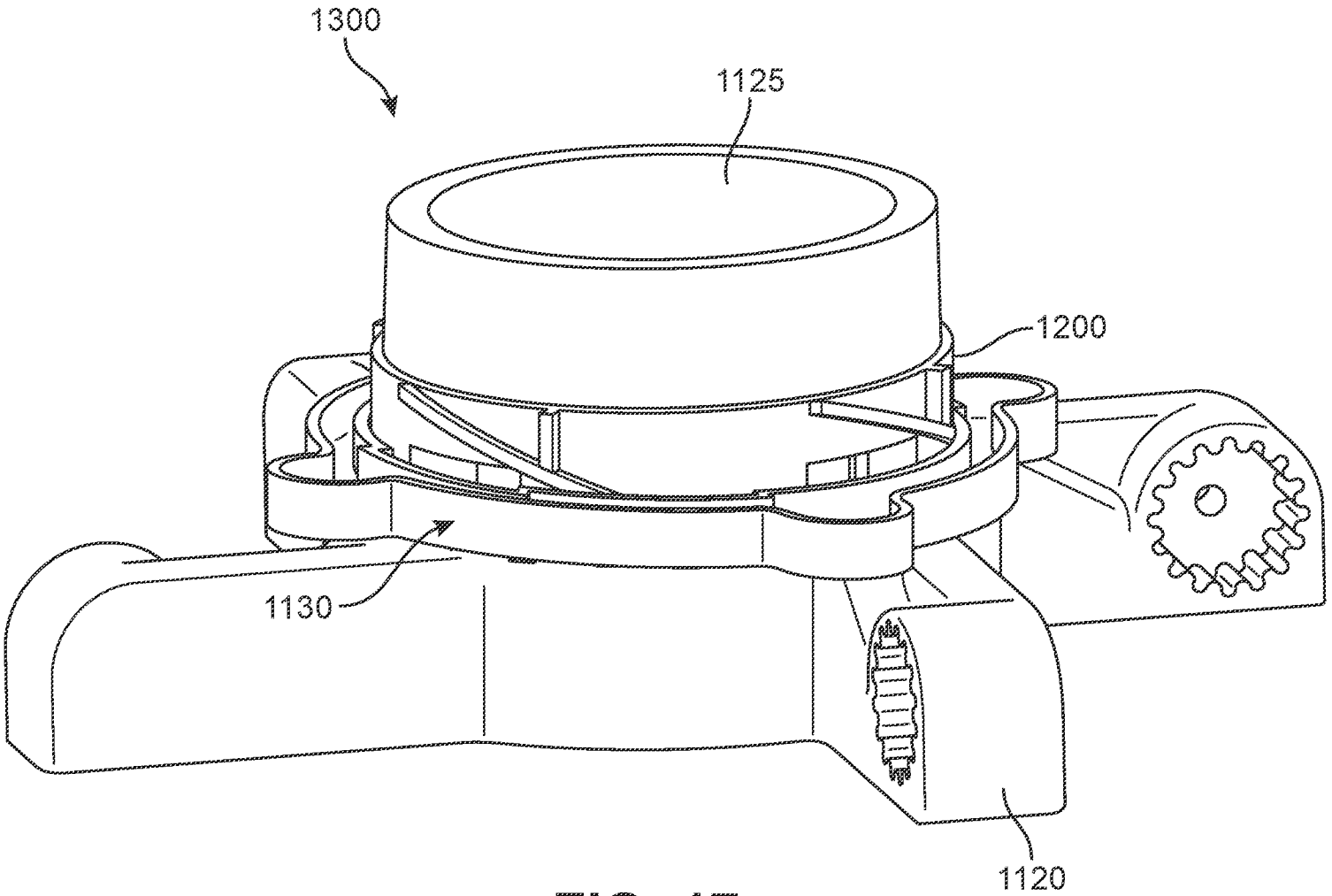
FIG. 17 is a schematic assembled view of the resistance adjustment system in the high resistance position with a compressible resistance member included.

FIG. 17 is a schematic assembled view of the resistance adjustment system in the high resistance position with a compressible resistance member included. In particular, compressible member 1125 is shown seated within the groove of elevating member 1200.

Figure 18:
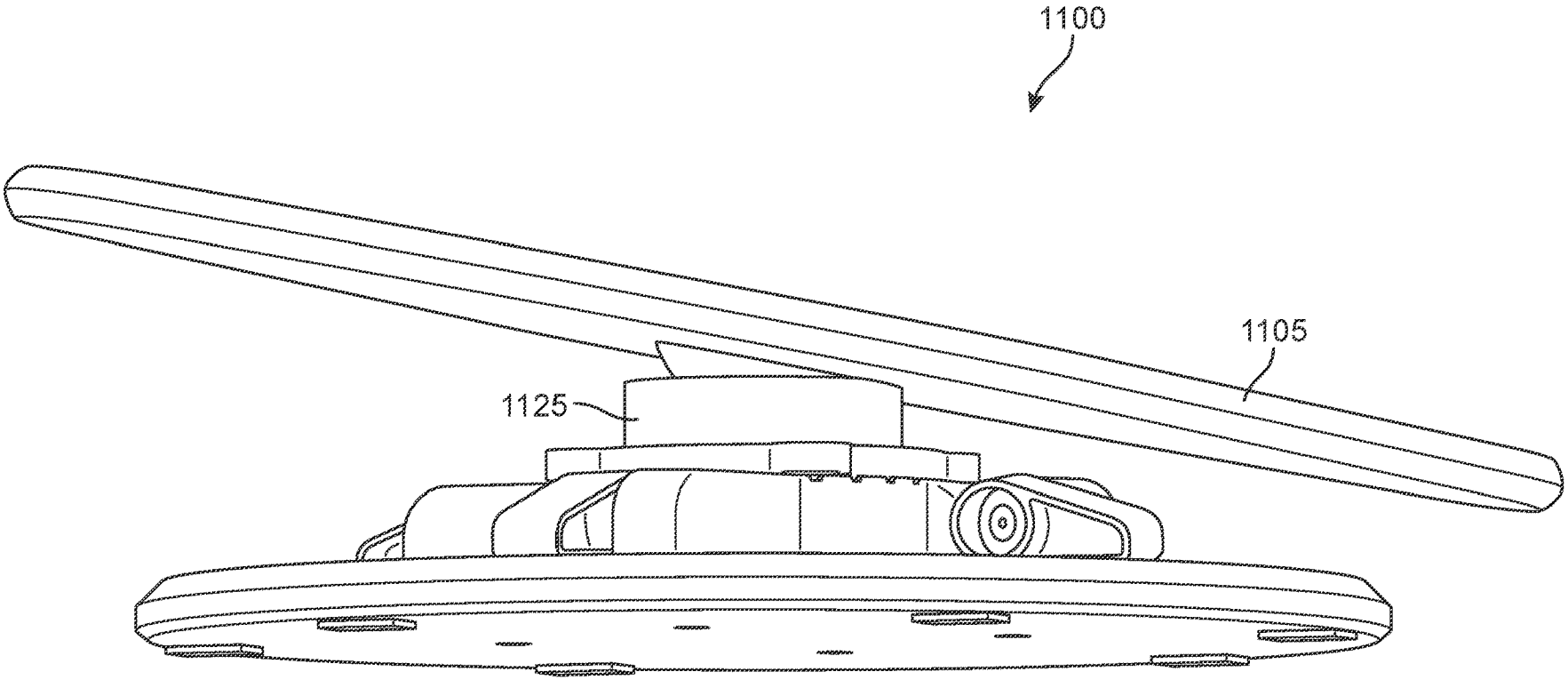
FIG. 18 is a schematic side view of the balance board shown in FIG. 11 shown in a tilted condition with the resistance adjustment system in a high resistance position.

FIG. 18 is a schematic side view of the balance board shown in FIG. 11 shown in a tilted condition with the resistance adjustment system in a high resistance position. That is, with compressible member 1125 raised to an elevated position, compressible member 1125 interferes with the tilting of upper plate 1105. Upper plate 1105 can still tilt with compressible member 1125 in this elevated position, but the compression of compressible member 1125 provides resistance to the tilting.

Figure 19:
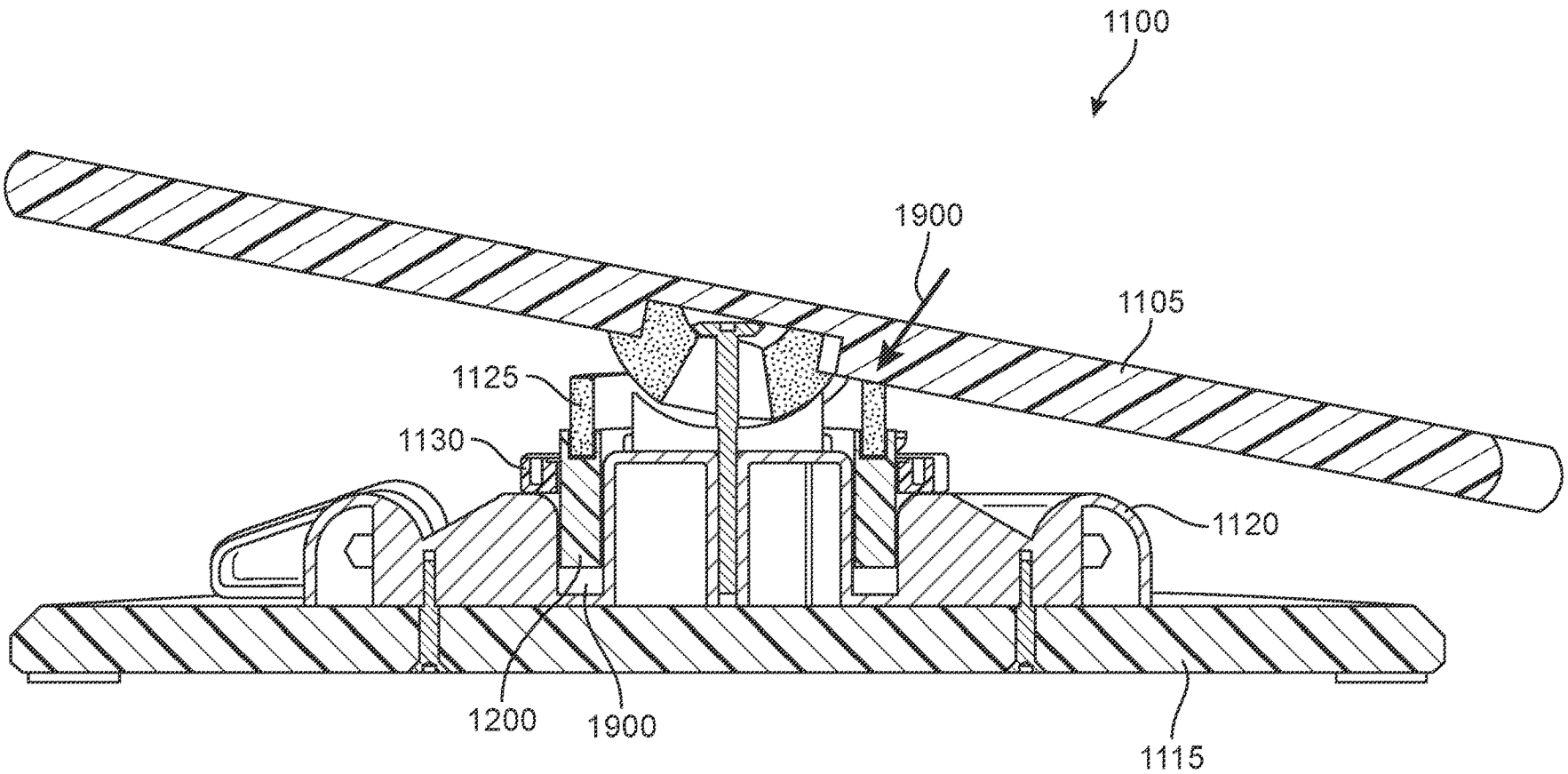
FIG. 19 is a schematic cross-sectional view of the balance board shown in FIG. 11 shown in a tilted condition with the resistance adjustment system in a high resistance position.

FIG. 19 is a schematic cross-sectional view of the balance board shown in FIG. 11 shown in a tilted condition with the resistance adjustment system in a high resistance position. As shown by a gap 1900 in FIG. 19, elevating member 1200 is raised with respect to support member 1120. At this elevated position, compressible member 1125 is raised such that it interferes with upper plate 1105 when it tilts, as illustrated by the compression of compressible member 1125 identified by an arrow 1900.

Figure 20:
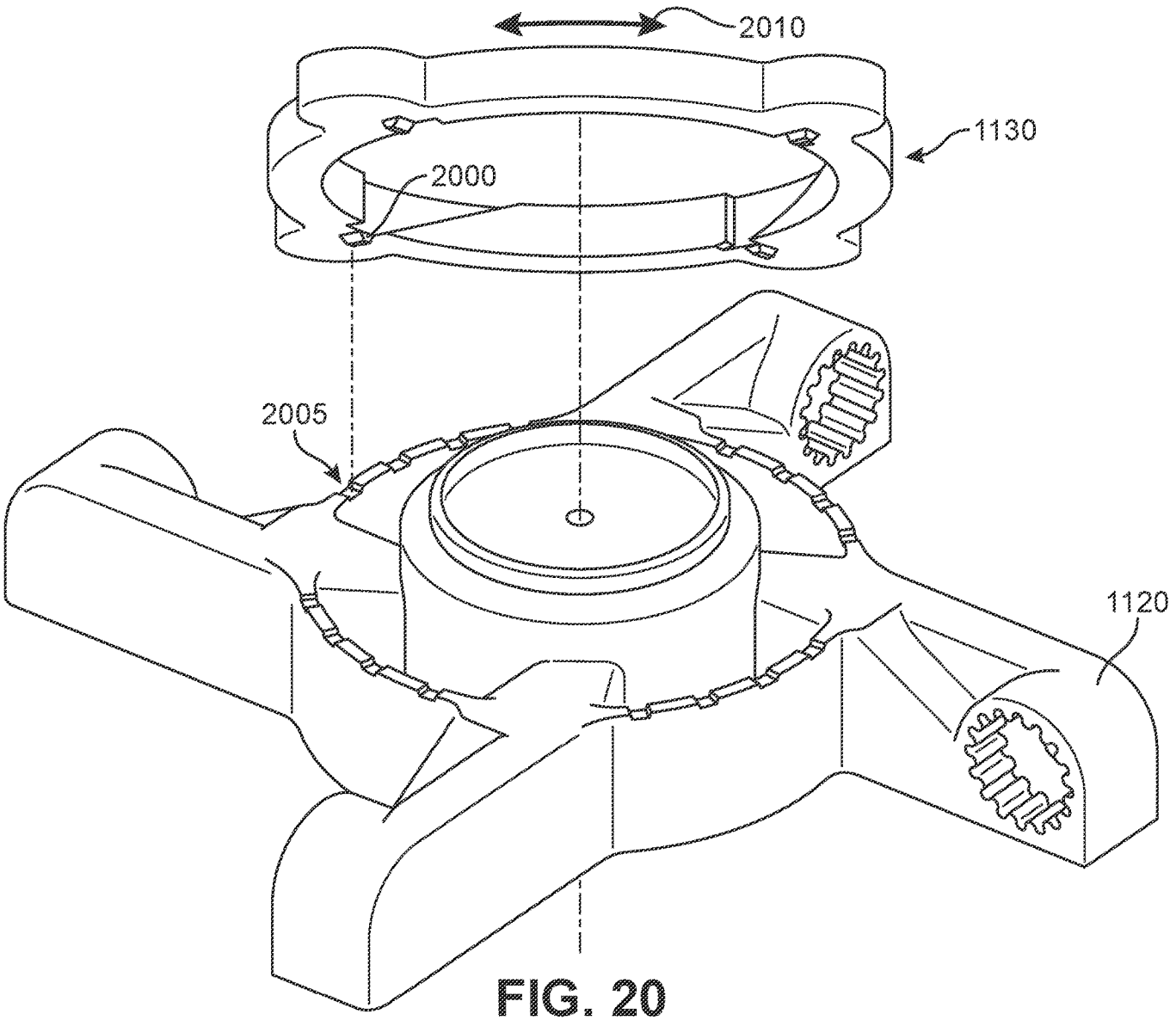
FIG. 20 is a schematic exploded view of an indexing system of the resistance adjustment system shown in FIG. 13.

FIG. 20 is a schematic exploded view of an indexing system of the resistance adjustment system shown in FIG. 13. As shown in FIG. 20, rotatable ring 1130 and support member 1120 may include an indexing system configured to regulate the rotation of the rotatable ring at intervals. For example, as shown in FIG. 20, in some embodiments, rotatable ring 1130 may include one or more protrusions 2000 and support member 1120 may include one or more sets of mating detents 2005. Upon rotation of rotatable ring 1130, illustrated by an arrow 2010, protrusions 2000 may come to rest in various detents 2005, and thus the rotation can be regulated to predetermined intervals.

The materials from which the balance board components may be formed may vary. In some embodiments, compressible member 125 and compressible member 1125 may be formed of a compressible, resilient foam material. Aside from the compressible members, the other components of the balance board may be formed of generally rigid materials, such as metal, wood, and/or plastic. For example, in some embodiments, the upper plate and base plate may be formed of wood, such as plywood. In addition, in some embodiments, the support member and adjustable angle stops may be formed of plastic. In some cases, an injection molded plastic may be used. In some cases, the components may be formed using additive manufacturing (e.g., 3D printing). In some embodiments, the ball joint components may be formed of materials that are inherently lubricious with respect to one another. Injection molded or 3D printed plastics may be used for these components as well. The fasteners may be metal, such as stainless steel.

While various embodiments of the invention have been described, the description is intended to be exemplary, rather than limiting, and it will be apparent to those of ordinary skill in the art that many more embodiments and implementations are possible that are within the scope of the invention. Any element of any embodiment may be substituted for another element of any other embodiment or added to another embodiment except where specifically excluded. Accordingly, the invention is not to be restricted except in light of the attached claims and their equivalents. Also, various modifications and changes may be made within the scope of the attached claims.

The invention claimed is:

1. A balance board, comprising:

an upper plate having a top surface configured for a user to stand on;

a base assembly configured to contact the ground;

a center assembly extending along a first axis between the upper plate and the base assembly and pivotally connecting the upper plate with the base assembly; and an adjustable tilt system comprising at least a first adjustable angle stop configured to be rotated at adjustable intervals about a second axis that is substantially perpendicular to the first axis to change a maximum angle by which the upper plate may be tilted relative to the base assembly;

wherein the base assembly includes a first plurality of teeth; and wherein the first adjustable angle stop includes a second plurality of teeth configured to interface with the first plurality of teeth of the base assembly to provide fixation of the first adjustable angle stop at the adjustable intervals.

2. The balance board of claim 1, wherein the base assembly includes a recess; and wherein the first plurality of teeth extend radially inwardly within the recess.

3. The balance board of claim 2, wherein the first adjustable angle stop includes a cylindrical protrusion configured to fit within the recess in the base assembly; and wherein the second plurality of teeth extend radially outwardly from the cylindrical protrusion.

4. The balance board of claim 1, wherein the second axis about which the first adjustable angle stop is configured to be rotated is oriented substantially horizontal when the balance board is positioned upright with a bottom of the base assembly in contact with the ground.

5. The balance board of claim 4, wherein the first adjustable angle stop has a cam, and wherein rotating the first adjustable angle stop adjusts a vertical location of the cam relative to the second axis about which the first adjustable angle stop is configured to rotate.

6. The balance board of claim 1, wherein the balance board includes a plurality of adjustable angle stops disposed around a periphery of the base assembly, the plurality of adjustable angle stops each having substantially the same configuration as the first adjustable angle stop.

7. The balance board of claim 6, wherein the plurality of adjustable angle stops includes four adjustable angle stops evenly spaced at 90 degree intervals around the periphery of the base assembly; and wherein the balance board is configured to be converted from a multi-axis wobble board to a single-axis rocker board by adjusting opposing adjustable angle stops to prevent pivotal movement of the upper plate about all but one horizontal axis.

8. A balance board, comprising:

an upper plate having a top surface configured for a user to stand on;

a base assembly configured to contact the ground; and a center assembly pivotally connecting the upper plate with the base assembly;

wherein the center assembly includes a compressible member configured to provide resistance to tilting of the upper plate with respect to the base assembly; and wherein the compressible member is configured to be raised and lowered with respect to the upper plate to change the amount of resistance to tilting provided by the compressible member;

further including a resistance adjustment system configured to raise and lower the compressible member with respect to the upper plate;

the resistance adjustment system including an elevating member and a rotatable ring;

the elevating member being configured to raise and lower the compressible member to adjust the resistance to tilting of the upper plate relative to the base assembly; and the rotatable ring being configured to raise and lower the elevating member to raise and lower the compressible member;

wherein the rotatable ring and the elevating member include an indexing system configured to regulate the rotation of the rotatable ring at intervals.

9. The balance board of claim 8, wherein the rotatable ring includes one or more spiral ramps configured to interact with one or more spiral ramps on the elevating member to raise and lower the elevating member.

10. The balance board of claim 8, wherein the elevating member includes a plurality of shoulders arranged in a stepped configuration such that positioning different steps against the support member incrementally adjusts the vertical placement of the elevating member relative to the base assembly.

11. The balance board of claim 8, further including an adjustable tilt system comprising at least a first adjustable angle stop configured to be rotated at adjustable intervals to change a maximum angle by which the upper plate may be tilted relative to the base assembly.

12. The balance board of claim 11, wherein the first adjustable angle stop is configured to be rotated about a substantially horizontal axis.

13. The balance board of claim 12, wherein the first adjustable angle stop has a cam, and wherein rotating the first adjustable angle stop adjusts a vertical location of the cam relative to the substantially horizontal axis about which the first adjustable angle stop is configured to rotate.

14. The balance board of claim 13, wherein the plurality of adjustable angle stops includes four adjustable angle stops evenly spaced at 90 degree intervals around the periphery of the base assembly; and wherein the balance board is configured to be converted from a multi-axis wobble board to a single-axis rocker board by adjusting opposing adjustable angle stops to prevent pivotal movement of the upper plate about all but one horizontal axis.

15. A balance board, comprising:

an upper plate having a top surface configured for a user to stand on;

a base assembly configured to contact the ground; and a center assembly pivotally connecting the upper plate with the base assembly;

wherein the center assembly includes a compressible member configured to provide resistance to tilting of the upper plate with respect to the base assembly; and wherein the compressible member is configured to be raised and lowered with respect to the upper plate to change the amount of resistance to tilting provided by the compressible member;

further including a resistance adjustment system configured to raise and lower the compressible member with respect to the upper plate;

the resistance adjustment system including an elevating member and a rotatable ring;

the elevating member being configured to raise and lower the compressible member; and the rotatable ring being configured to raise and lower the elevating member;

wherein the rotatable ring includes one or more spiral ramps configured to interact with one or more spiral ramps on the elevating member to raise and lower the elevating member.

16. The balance board of claim 15, wherein the rotatable ring and the elevating member include an indexing system configured to regulate the rotation of the rotatable ring at intervals.

17. The balance board of claim 15, further including an adjustable tilt system comprising at least a first adjustable angle stop configured to be rotated at adjustable intervals to change a maximum angle by which the upper plate may be tilted relative to the base assembly.

18. The balance board of claim 17, wherein the first adjustable angle stop is configured to be rotated about a substantially horizontal axis.

19. The balance board of claim 18, wherein the first adjustable angle stop has a cam, and wherein rotating the first adjustable angle stop adjusts a vertical location of the cam relative to the substantially horizontal axis about which the first adjustable angle stop is configured to rotate.

20. The balance board of claim 19, wherein the plurality of adjustable angle stops includes four adjustable angle stops evenly spaced at 90 degree intervals around the periphery of the base assembly; and wherein the balance board is configured to be converted from a multi-axis wobble board to a single-axis rocker board by adjusting opposing adjustable angle stops to prevent pivotal movement of the upper plate about all but one horizontal axis.

* * * * *